US011118356B2

(12) United States Patent
Rivest

(10) Patent No.: US 11,118,356 B2
(45) Date of Patent: Sep. 14, 2021

(54) SKYLIGHT PROTECTION ASSEMBLY AND METHOD FOR PROTECTING A SKYLIGHT

(71) Applicant: CIELLA INC., Saint-Eustache (CA)

(72) Inventor: Serge Rivest, Saint-Eustache (CA)

(73) Assignee: CIELLA INC., Saint-Eustache (CA)

( * ) Notice: Subject to any disclaimer, the term of this patent is extended or adjusted under 35 U.S.C. 154(b) by 38 days.

(21) Appl. No.: 16/681,034

(22) Filed: Nov. 12, 2019

(65) Prior Publication Data

US 2020/0149282 A1 May 14, 2020

Related U.S. Application Data

(60) Provisional application No. 62/760,407, filed on Nov. 13, 2018.

(51) Int. Cl.

| | |
|---|---|
| ***E04D 13/03*** | (2006.01) |
| ***E04D 3/36*** | (2006.01) |
| ***E04D 3/18*** | (2006.01) |

(52) U.S. Cl.

CPC ..... *E04D 13/0335* (2013.01); *E04D 3/18* (2013.01); *E04D 3/3605* (2013.01); *E04D 13/031* (2013.01); *E04D 13/0315* (2013.01)

(58) Field of Classification Search

CPC ..... E04D 3/18; E04D 3/3605; E04D 13/031; E04D 13/0315; E04D 13/0335

See application file for complete search history.

(56) References Cited

U.S. PATENT DOCUMENTS

| | | | | |
|---|---|---|---|---|
| 1,233,530 A * | 7/1917 | Whitnell | ..... | E04D 13/03 52/200 |
| 1,236,008 A * | 8/1917 | Rysdon | ..... | E04D 13/0335 52/200 |
| 2,515,451 A * | 7/1950 | Isacoff | ..... | E04D 13/0335 160/88 |
| 4,930,274 A * | 6/1990 | Cummings | ..... | E04D 13/031 52/200 |
| 5,179,992 A * | 1/1993 | Okarski | ..... | E04D 13/033 160/327 |

(Continued)

OTHER PUBLICATIONS

Cella puits de lumières. « Couvre puits de lumière ». Jun. 28, 2015. online advertising : https://www.ciella.ca/couvre-puits-de-lumierei/, accessed Jan. 14, 2020, 3 pages.

*Primary Examiner* — James M Ference

(74) *Attorney, Agent, or Firm* — Dinsmore & Shohl LLP

(57) ABSTRACT

The present disclosure concerns a skylight protection assembly to protect a skylight of a roof. The skylight protection assembly comprises a frame superposable to a mounting surface of the roof to surround at least partially the skylight and securable to the roof, the frame comprising at least one frame member having a roof-engaging portion, a screen-supporting portion and an outer side; a protection screen engageable with the screen-supporting portion of said at least one frame member to define with the frame a skylight protection chamber configured to contain the skylight. The frame member comprises an upper frame member, the outer side of the upper frame member having a water-flowing profile considered in a plane substantially parallel to the mounting surface of the roof. The present disclosure also concerns a method for protecting a skylight of a roof.

20 Claims, 20 Drawing Sheets

(56) References Cited

U.S. PATENT DOCUMENTS 5,237,788 A * 8/1993 Sandow ..... E04D 13/0335 292/246
D354,817 S * 1/1995 Kovacs ..... D25/48.8
5,419,090 A * 5/1995 Sandow ..... E04D 3/32 52/200
5,502,934 A * 4/1996 Coyne ..... E04D 13/0335 49/50
5,913,785 A * 6/1999 Møller ..... E04D 13/0305 49/DIG. 1
6,009,929 A * 1/2000 Linderman ..... E04D 13/033 160/104
6,014,845 A * 1/2000 Jain ..... E04D 13/033 359/591
6,161,348 A * 12/2000 Morris ..... E04D 13/03 49/1
6,199,330 B1 * 3/2001 Cobb ..... E04D 13/0335 49/57
6,209,271 B1 * 4/2001 Kovacs ..... E04D 13/0335 49/50
6,272,800 B1 * 8/2001 Phinney ..... E04D 13/0335 182/112
7,134,254 B1 * 11/2006 Van Gelder ..... E04D 13/0335 52/793.1
8,061,092 B2 * 11/2011 McClure ..... E04D 3/364 52/200
8,443,555 B2 * 5/2013 Chapus ..... E04H 4/08 52/64
8,782,973 B1 * 7/2014 Everingham ..... E04D 13/0335 52/200
9,194,128 B1 * 11/2015 Fawley ..... E04D 13/0325
9,212,489 B1 * 12/2015 Erickson ..... E04B 1/92
10,145,117 B2 * 12/2018 Bilbrey ..... G02B 5/003
2002/0139063 A1 * 10/2002 Crane ..... E04D 13/0315 52/106
2004/0104382 A1 * 6/2004 Collins ..... E04G 21/3223 256/59
2004/0232402 A1 * 11/2004 Beirne, Jr. ..... E04F 11/181 256/59
2007/0228352 A1 * 10/2007 Higgs ..... E04G 21/3233 256/59
2008/0256864 A1 * 10/2008 Stoffels ..... E04D 13/0335 49/55
2009/0031649 A1 * 2/2009 Nemazi ..... E04D 13/0315 52/200
2009/0107060 A1 * 4/2009 Ellis ..... E04D 13/0335 52/200
2011/0120030 A1 * 5/2011 Swindell, III ..... E04D 13/0335 52/202
2020/0149282 A1 * 5/2020 Rivest ..... E04D 13/0335

* cited by examiner

SKYLIGHT PROTECTION ASSEMBLY AND METHOD FOR PROTECTING A SKYLIGHT

PRIOR APPLICATION

The present application claims priority from U.S. provisional patent application No. 62/760,407, filed on Nov. 13, 2018, and entitled "SKYLIGHT PROTECTION ASSEMBLY", the disclosure of which being hereby incorporated by reference in its entirety.

TECHNICAL FIELD

The technical field relates to roof protection assemblies, and more particularly to skylight protection assemblies and to methods to protect skylights.

BACKGROUND

Roofs may comprise skylights to admit natural light in an interior space. However, skylights can be easily damaged, for instance due to the fall of hailstorms or rain. Moreover, snowfalls might bring about water ingress and condensation issues, especially when the snow melts.

In view of the above, there is a need for a skylight protection assembly which would be able to overcome or at least minimize some of the above-discussed prior art concerns.

BRIEF SUMMARY

It is therefore an aim of the present invention to address the above-mentioned issues.

According to a general aspect, there is provided a skylight protection assembly to protect a skylight of a roof. The skylight protection assembly comprises a frame superposable to a mounting surface of the roof to surround at least partially the skylight and securable to the roof, the frame comprising at least one frame member having a roof-engaging portion, a screen-supporting portion and an outer side; a protection screen engageable with the screen-supporting portion of said at least one frame member to define with the frame a skylight protection chamber configured to contain the skylight. At least one frame member comprises an upper frame member, the outer side of the upper frame member having a water-flowing profile considered in a plane substantially parallel to the mounting surface of the roof.

According to another general aspect, there is provided a skylight protection assembly to protect a skylight of a roof. The skylight protection assembly comprises a frame superposable to a mounting surface of the roof to surround at least partially the skylight and securable to the roof, the frame comprising at least one frame member having a roof-engaging portion and a screen-supporting portion; a protection screen engageable with the screen-supporting portion of said at least one frame member to define with the frame a skylight protection chamber configured to contain the skylight. At least one frame member comprises at least one air circulation aperture to allow an air circulation between the skylight protection chamber and an outside thereof.

According to another general aspect, there is provided a method for protecting a skylight of a roof, comprising providing a skylight protection assembly comprising first and second frame members having a roof-engaging portion and a screen-supporting portion, a protection screen, and first and second screen connectors comprising a frame-mounting portion and a screen-receiving portion; securing the frame to the roof around the skylight; mounting the frame-mounting portion of the first screen connector to the screen-supporting portion of the first frame member; engaging a first lateral side of the protection screen in a screen engagement slot formed in the screen-receiving portion of the first screen connector; engaging a second lateral side of the protection screen with the screen-receiving portion of the second screen connector; and mounting the frame-mounting portion of the second screen connector to the second frame member.

According to another general aspect, there is provided a skylight protection assembly to protect a skylight of a roof. The skylight protection assembly comprises a frame superposable to the roof to surround at least partially the skylight and securable thereto, the frame comprising a roof-engaging portion and a screen-supporting portion, and a protection screen engageable with the screen-supporting portion of the frame to define with the frame a skylight protection chamber containing the skylight. The protection screen is substantially dome-shaped when mounted to the frame.

According to another general aspect, there is provided a skylight protection assembly to protect a skylight of a roof. The skylight protection assembly comprises a frame superposable to the roof to surround at least partially the skylight and securable thereto, the frame comprising a roof-engaging portion and a screen-supporting portion and a protection screen engageable with the screen-supporting portion of the frame to define with the frame a skylight protection chamber containing. The screen-supporting portion of the frame defines a convex curvature profile for the protection screen to have a substantially convex profile towards an outside of the skylight protection chamber when mounted to the frame.

According to another general aspect, there is provided a skylight protection assembly to protect a skylight of a roof. The skylight protection assembly comprises a frame superposable to the roof to surround at least partially the skylight and securable thereto. The frame comprises a pair of first and second lateral frame members spaced apart from each other, each of the first and second lateral frame members having a roof-engaging portion and a screen-supporting portion and a pair of upper and lower frame members spaced apart from each other and extending between the first and second lateral frame members, each of the upper and lower frame members having a roof-engaging portion and a screen-supporting portion. The skylight protection assembly further comprises a protection screen engageable with the screen-supporting portions of the frame to define with the frame a skylight protection chamber containing the skylight. The screen-supporting portions of at least one of the pairs of first and second lateral frame members and upper and lower frame members are curved for the protection screen to have a substantially convex profile towards an outside of the skylight protection chamber when mounted to the frame.

According to another general aspect, there is provided a kit for forming a skylight protection assembly according to the present disclosure.

According to another general aspect, there is provided a method for protecting a skylight of a roof. The method comprises providing a skylight protection assembly according to the present disclosure, engaging the protection screen with the frame and securing the frame with the protection screen engaged therewith to the roof around the skylight.

According to another general aspect, there is provided a method for protecting a skylight of a roof. The method comprises providing a skylight protection assembly according to the present disclosure, securing the frame to the roof around the skylight and engaging the protection screen with the frame secured to the roof.

DETAILED DESCRIPTION

Figure 1:
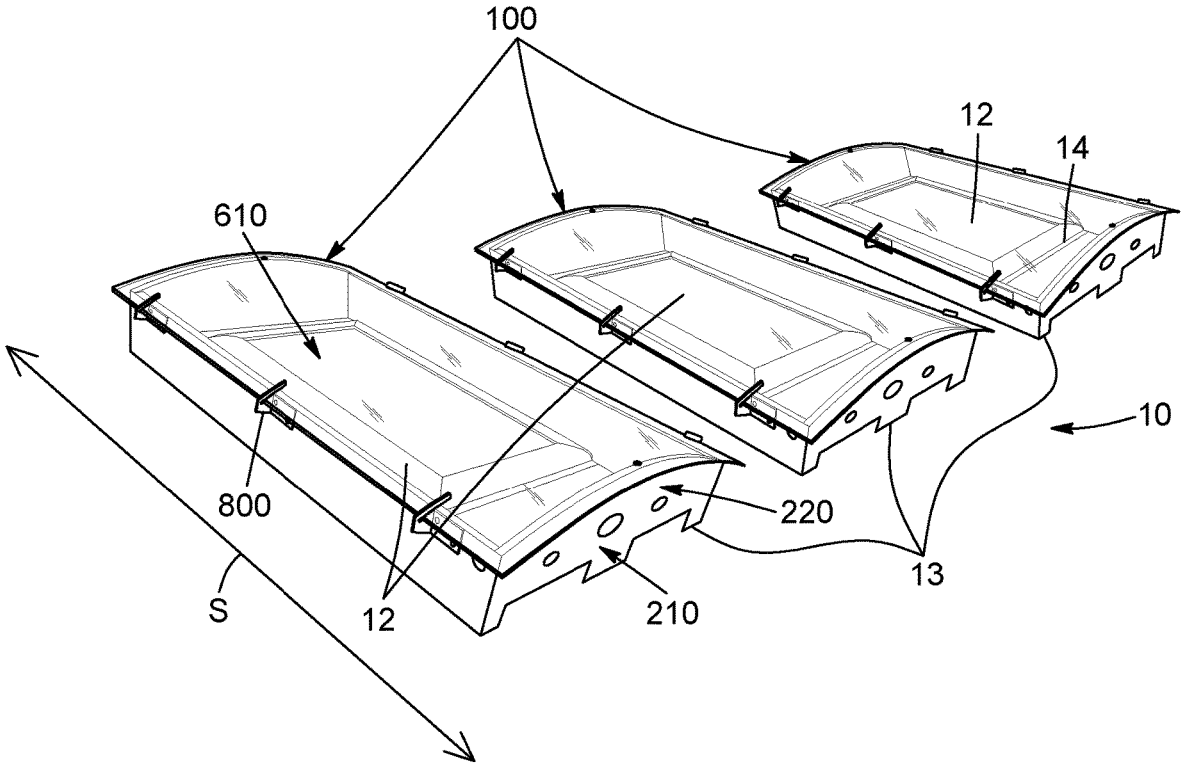
FIG. 1 is a top perspective view of skylight protection assemblies in accordance with an embodiment, each skylight protection assembly comprising a frame and a protection screen and covering a skylight of a roof.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional and are given for exemplification purposes only.

Moreover, it will be appreciated that positional descriptions such as "above", "below", "forward", "rearward", "left", "right" and the like should, unless otherwise indicated, be taken in the context of the figures only and should not be considered limiting. Moreover, the figures are meant to be illustrative of certain characteristics of the skylight protection assembly and are not necessarily to scale.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, an embodiment is an example or implementation. The various appearances of "one embodiment", "an embodiment" or "some embodiments" do not necessarily all refer to the same embodiments. Although various features may be described in the context of a single embodiment, the features may also be provided separately or in any suitable combination. Conversely, although the invention may be described herein in the context of separate embodiments for clarity, it may also be implemented in a single embodiment. Reference in the specification to "some embodiments", "an embodiment", "one embodiment" or "other embodiments" means that a particular feature, structure, or characteristic described in connection with the embodiments is included in at least some embodiments, but not necessarily all embodiments.

It is to be understood that the phraseology and terminology employed herein is not to be construed as limiting and are for descriptive purpose only. The principles and uses of the teachings of the present disclosure may be better understood with reference to the accompanying description, figures and examples. It is to be understood that the details set forth herein do not construe a limitation to an application of the disclosure.

Furthermore, it is to be understood that the disclosure can be carried out or practiced in various ways and that the disclosure can be implemented in embodiments other than the ones outlined in the description above. It is to be understood that the terms "including", "comprising", and grammatical variants thereof do not preclude the addition of one or more components, features, steps, or integers or groups thereof and that the terms are to be construed as specifying components, features, steps or integers. If the specification or claims refer to "an additional" element, that does not preclude there being more than one of the additional element. It is to be understood that where the claims or specification refer to "a" or "an" element, such reference is not be construed that there is only one of that element. It is to be understood that where the specification states that a component, feature, structure, or characteristic "may", "might", "can" or "could" be included, that particular component, feature, structure, or characteristic is not required to be included.

The descriptions, examples, methods and materials presented in the claims and the specification are not to be construed as limiting but rather as illustrative only. Meanings of technical and scientific terms used herein are to be commonly understood as by one of ordinary skill in the art to which the invention belongs, unless otherwise defined. It will be appreciated that the methods described herein may be performed in the described order, or in any suitable order.

Figure 2:
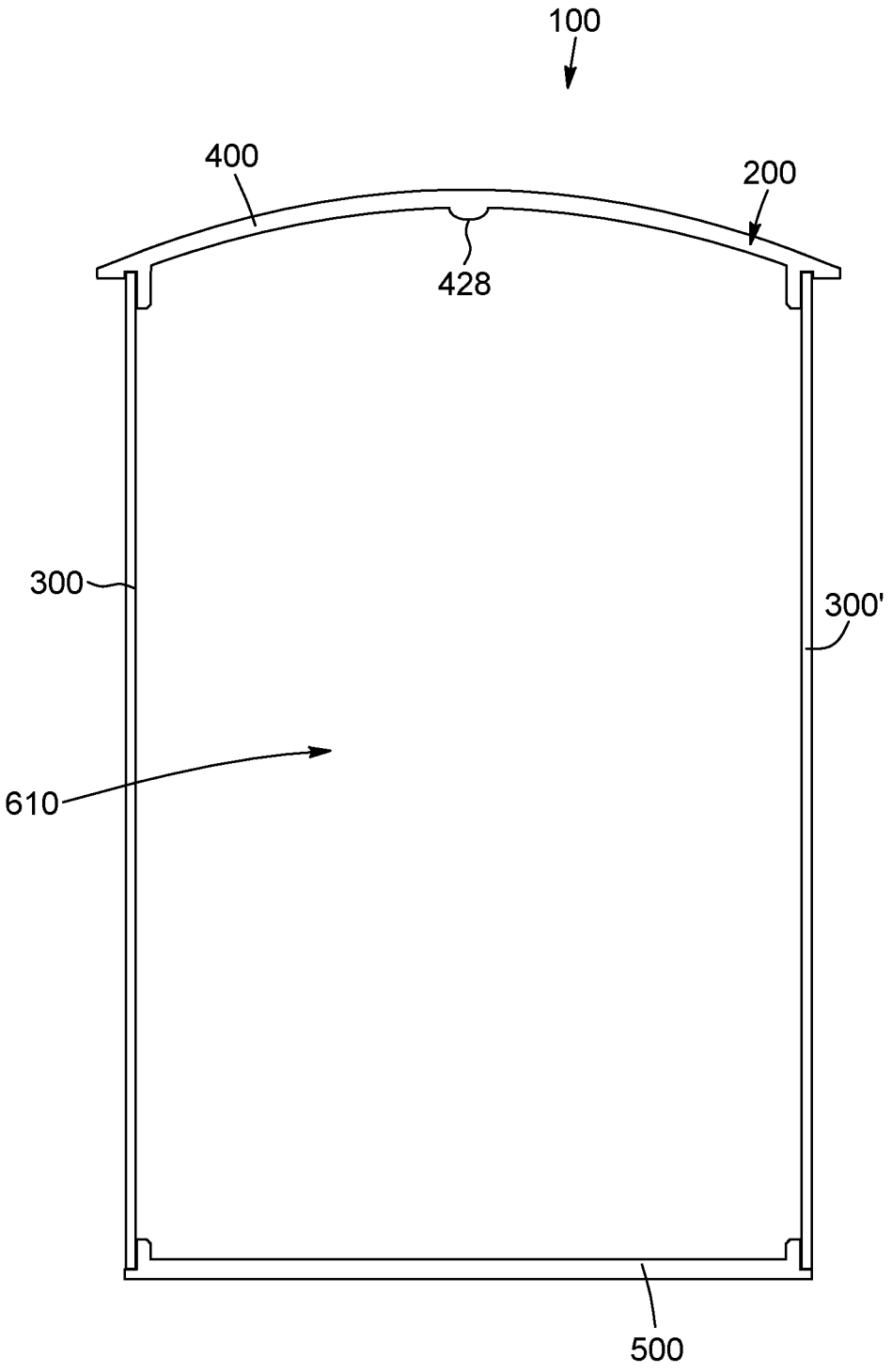
FIG. 2 is a cross-section view of the frame of one of the skylight protection assemblies of FIG. 1.
Figure 3:
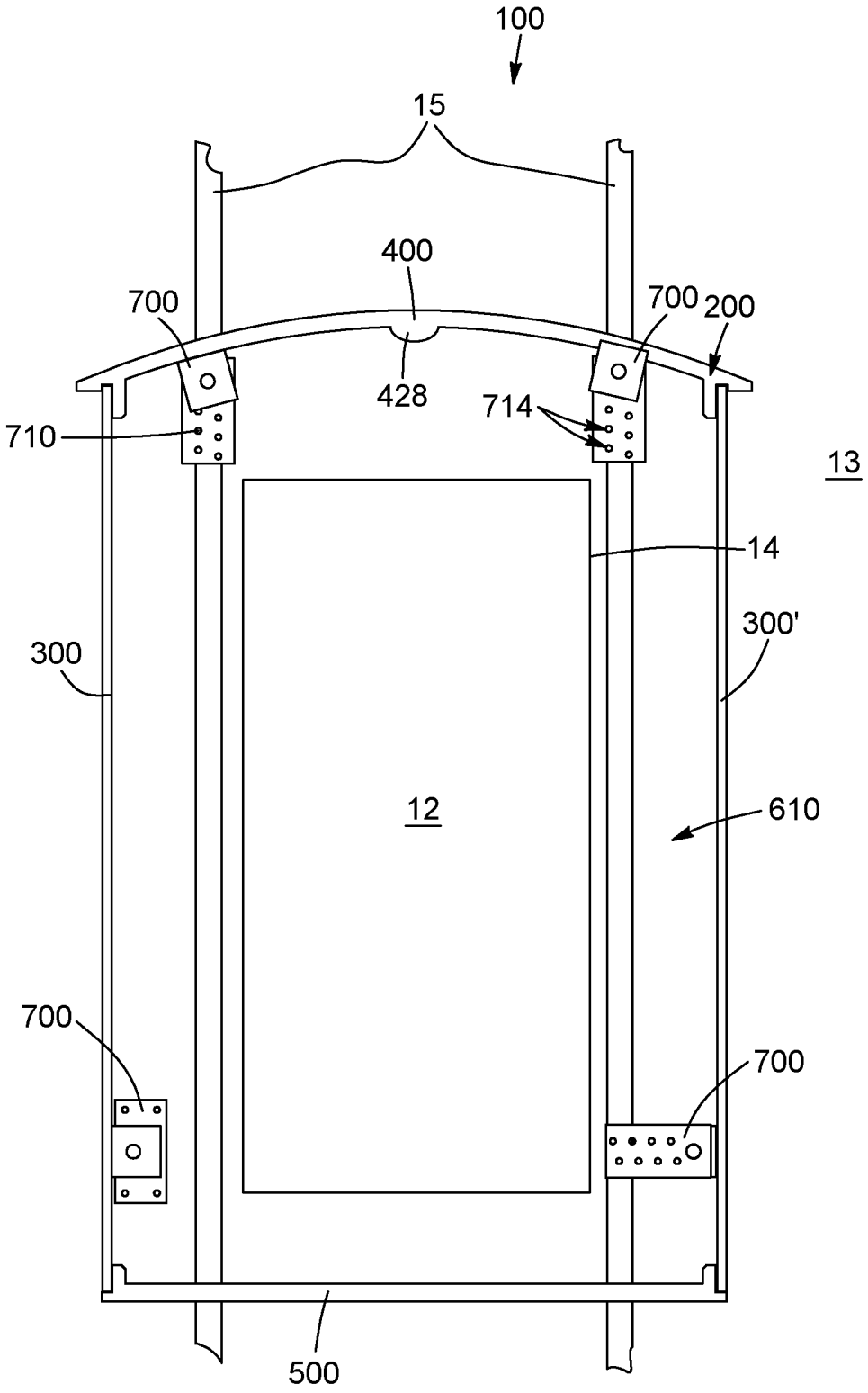
FIG. 3 is a top plan view of the frame of one of the skylight protection assemblies of FIG. 1 mounted to the roof and superposed to a mounting surface thereof and surrounding a respective one of the skylights.

Referring now to the drawings, and more particularly to FIGS. 1 to 3, there is shown a skylight protection assembly 100 (or skylight cover 100) that is configured to protect a skylight 12 covering an aperture defined in a roof 10. In the embodiment shown, the skylight 12 is substantially rectangular in shape and has a substantially rectangular outer periphery 14. In the embodiment shown, the roof 10 is sloping and defines a sloping direction S, but the skylight protection assembly 100 could also protect a skylight 12 mounted to a flat roof 10 or a skylight having a non-rectangular shape or could even protect a portion of a roof 10 without surrounding a skylight mounted thereto.

The skylight protection assembly 100 is mountable—removably mountable, in the embodiment shown—to the roof 10 around a respective skylight 12 and superposable against a mounting surface—or outer surface—13 thereof. The skylight protection assembly 100 comprises a frame 200 superposable to the roof 10 and configured to surround the skylight 12. Thus, a perimeter defined by the frame 200 is greater, in length and in width, respectfully considered in directions substantially perpendicular and parallel to the sloping direction S of the roof 10, than a perimeter of the outer periphery 14 of the skylight 12, which is surrounded by the frame 200.

Figure 22A:
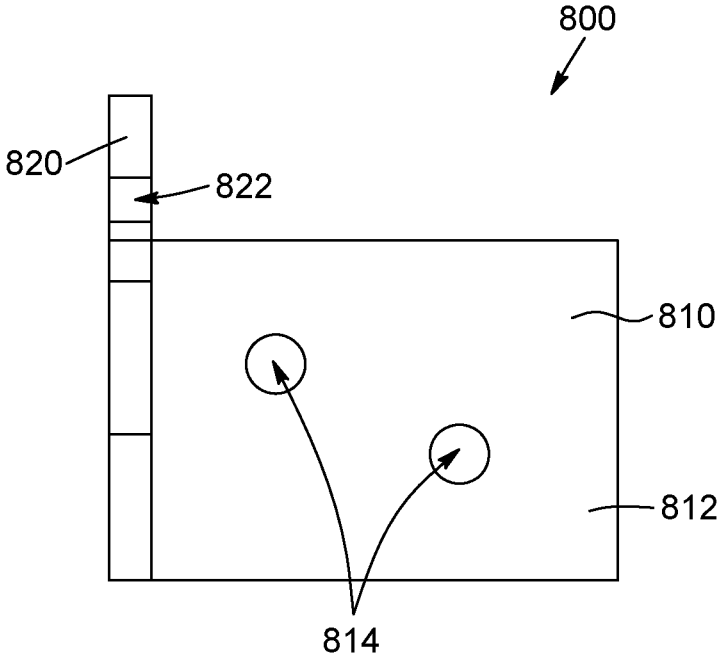
FIGS. 22A, 22B and 22C are respectively a side elevation view, a front elevation view and a top elevation view of a screen connector in accordance with an embodiment.
Figure 22B:
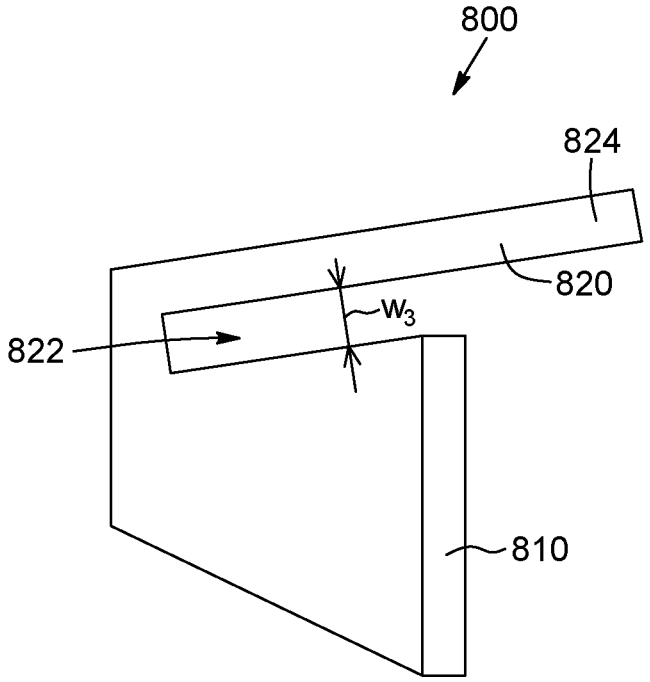
Figure 22C:
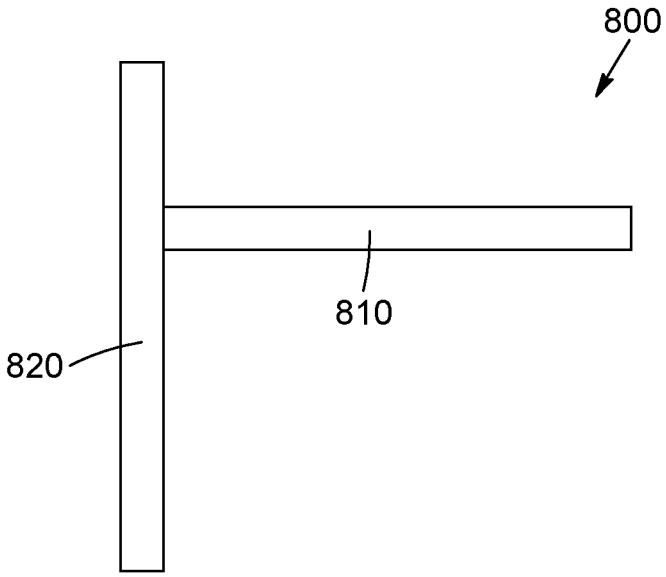
Figure 22D:
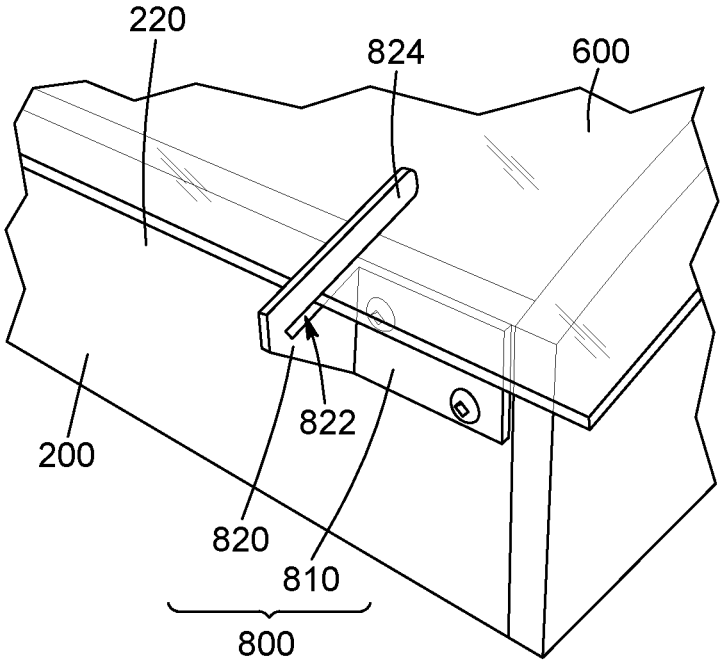
FIG. 22D is a top perspective view of the screen connector of FIGS. 22A to 22C mounted to the frame of FIG. 3, a portion of the protection screen being engaged with the screen connector.

The frame 200 comprises a roof-mounting portion 210 (or roof-engaging portion 210) configured to removably mount the frame 200 to the roof 10 (to superpose the frame against the mounting surface 13 thereof), and a screen-supporting portion 220. The skylight protection assembly 100 further comprises a protection screen 600 (FIGS. 22D and 23) removably engageable with the frame 200 and supported by the screen-supporting portion 220 of the frame 200, when mounted thereto, to cover the skylight 12. When the protection screen 600 is mounted to the frame 200, they define together a skylight protection chamber 610 dimensioned and shaped to contain/cover the skylight 12. The term "contain" should be understood, in the following description, as meaning that at least an outer part of the skylight 12, with reference to an inner volume of a building delimited by the roof 10, is covered by the skylight protection assembly 100 when the frame 200 thereof is superposed against the mounting surface 13 of the roof 10. In other words, it should be understood that the skylight protection chamber 610 is not necessarily shaped and dimensioned to contain an entirety of the skylight 12. In particular, the inner portion of the skylight 12 (i.e. the portion extending under the roof 10) is not contained within the skylight protection chamber 610.

As it will be apparent from the description below, the skylight protection assembly 100 is configured and shaped to protect the skylight 12, for example from weather elements.

In the following description, the terms outer, inner, outwardly, inwardly and the like will refer, unless otherwise stated, to the skylight protection chamber 610.

Frame

Figure 6:
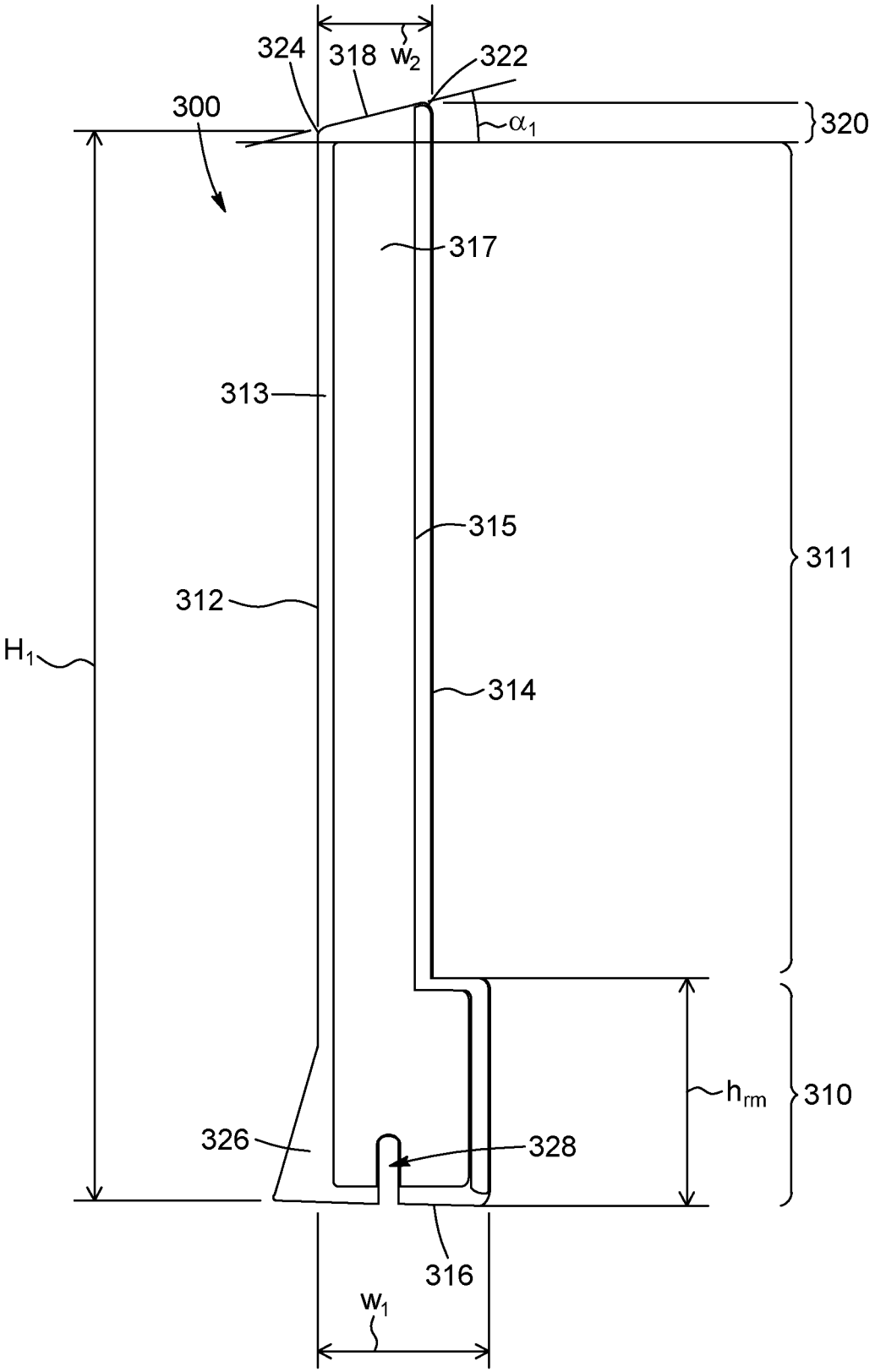
FIG. 6 is a cross-section view of the lateral frame member of FIG. 5.

In the embodiment shown, as represented in FIGS. 2, 3 and 6, the frame 200 of the skylight protection assembly 100 comprises a plurality of frame members. In the embodiment shown, the frame 200 comprises a pair of first and second lateral frame members 300, 300' spaced apart from each other. Each of the first and second lateral frame members 300, 300' has a roof-mounting portion 310 and a screen-supporting portion 320 forming respectively and partially the roof-mounting portion 210 (or roof-engaging portion) of the frame 200 and the screen-supporting portion 220 of the frame 200.

The frame 200 further comprises an upper frame member 400 and a lower frame member 500 spaced apart from each other and extending between the first and second lateral frame members 300, 300'; each of the upper and lower frame members 400, 500 has a roof-mounting portion 410, 510, forming partially the roof-mounting portion 210 of the frame 200, and a screen-supporting portion 420, 520, forming partially the screen-supporting portion 220 of the frame 200. The terms "upper" and "lower", in the present description refer, unless otherwise stated, to the sloping direction S of the roof 10.

In the embodiment shown, the frame 200 is substantially rectangular in shape. The first and second lateral frame members 300, 300' extend substantially parallel to each other and substantially parallel to the sloping direction S when superposed against the mounting surface 13 of the roof 10. The lower frame member 500 extends substantially perpendicular to and between the first and second lateral frame members 300, 300'. The upper frame members 400 extends between the first and second lateral frame members 300, 300' and is spaced apart from the lower frame member 500. The upper and lower frame members 400, 500 thus extend substantially parallel to each other and substantially perpendicular to the sloping direction S of the roof 10.

It is thus understood that the roof-mounting portion 210 and the screen-supporting portion 220 of the frame 200 are constituted respectively by the roof-mounting portions and the screen-supporting portions of the different frame members 300, 300',400, 500 forming together the frame 200. The frame 200 is thus formed of four distinct frame members securable together, but a frame 200 having a smaller or a greater number of frame members could also be conceived.

Figure 9:
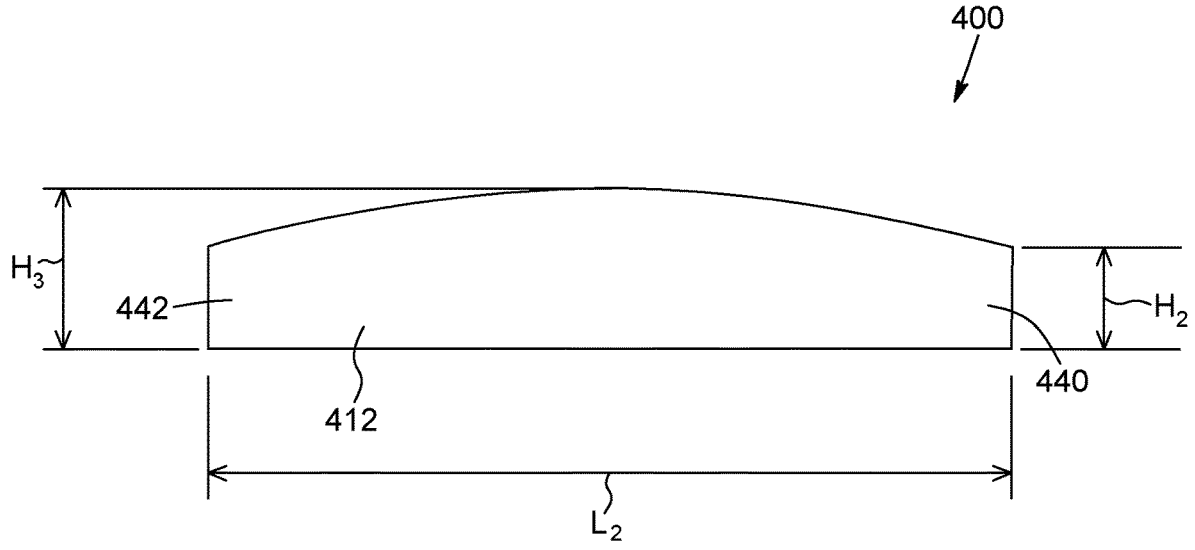
FIG. 9 is a rear elevation view of an upper frame member of the frame of FIG. 2.
Figure 16:
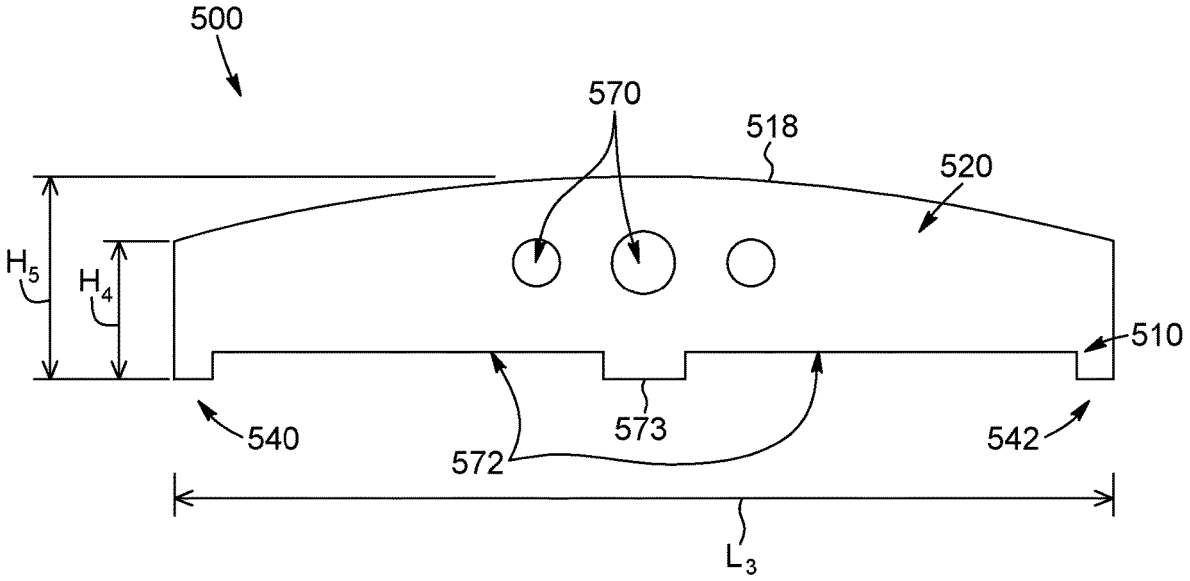
FIG. 16 is a front elevation view of a lower frame member of the frame of FIG. 2.

As represented for instance in FIGS. 9 and 16, the screen-supporting portion 220 of the frame 200 (at least the upper and lower frame members 400, 500 thereof) is at least partially curved for the protection screen 600 to have a substantially convex profile towards an outside of the skylight protection chamber 610 (i.e. away from the skylight protection chamber 610) when mounted to the frame 200. In other words, the screen-supporting portions of at least one of the frame members (i.e. at least one of the pair of first and second lateral frame members 300, 300' and the upper and lower frame members 400, 500) are sloped or outwardly curved for the protection screen 600 to have a substantially convex profile towards an outside of the skylight protection chamber 610 when mounted to the frame 200. In the embodiment shown, as described below, the screen-supporting portions 420, 520 of the upper and lower frame members 400, 500 are outwardly curved or sloped (i.e. have a substantially convex profile towards the outside of the skylight protection chamber 610 or away from the skylight protection chamber 610). In the embodiment shown, a profile of the first and second lateral frame members 300, 300' along respective widths and lengths follows a curved or sloped profile of the upper and lower frame members 400, 500. In other words, and as detailed below, a continuity is formed between screen-contacting faces of the upper, lower and first and second lateral frame members for the different screen-contacting faces to substantially fit the profile of an inner face of the protection screen 600.

Moreover, the frame 200 is dimensioned for the protection screen 600 to be spaced-apart from the skylight 12 when the skylight protection assembly 100 is mounted to the roof 10. In the embodiment shown, the first and second lateral frame members 300, 300' and the upper and lower frame members 400, 500 have a height sufficient to at least partially allow an opening of the skylight 12, when the skylight protection assembly 100 is mounted to the roof 10 over the skylight 12.

In the embodiment shown, the frame 200 is made of four distinct frame members forming respectively the upper, lower and first and second lateral frame members 400, 500, 300, 300'. It could also be conceived a frame comprising more or less components, and/or a frame that would comprise all or parts of upper, lower and/or first and second lateral frame members that would be composed of more or less components. It could for instance be conceived a frame that would comprise four angular frame members securable to each other (for instance removably mountable to each other), each of the four angular frame members forming portions of first and second ones of the upper, lower and first and second lateral frame members. For instance, it could be conceived a frame member wherein a first angular frame member would form a left portion of the upper frame member and a top portion of the first lateral frame member, whereas a second angular frame member would form a right portion of the upper frame member and a top portion of the second lateral frame member.

First and Second Lateral Frame Members

In the embodiment shown, the first and second lateral frame members 300, 300' have a similar shape, so that the following description of the first lateral frame member 300 will apply to both of them. It could however also be conceived a frame that would have first and second lateral frame members 300, 300' with different technical features, shapes and/or dimensions.

As illustrated in FIGS. 5 to 8, the first lateral frame member 300 comprises opposed outer and inner faces 312, 314 (considered with respect to the skylight protection chamber 610), extending substantially parallel to each other, substantially parallel to the sloping direction S when mounted to the roof 10, and substantially vertically. The first lateral frame member 300 further comprises a roof-juxtaposable face 316 (or roof-adjacent face) and the screen-supporting portion 320 has a screen-contacting face 318 extending between the outer and inner faces 312, 314.

Figure 7:
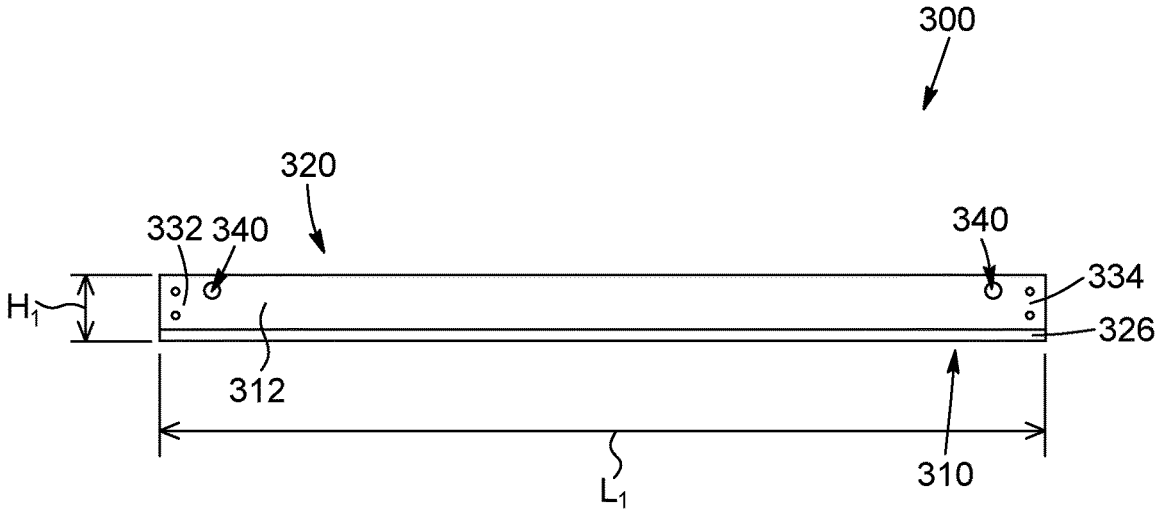
FIGS. 7 and 8 are respectively outer and inner side elevation views of the lateral frame member of FIG. 5.

As illustrated in FIG. 6, the screen-contacting face 318 has an inner edge 322 and an outer edge 324 and the screen-contacting face 318 is angled downwardly from the inner edge 322 towards the outer edge 324. In other words, considered in plane transversal to a longitudinal direction of the first lateral frame member 300 (i.e. transversal to a length L1 of the first lateral frame member 300 as represented in FIG. 7, for instance perpendicular to the length L1, in the embodiment shown), the screen-contacting face 318 forms a slope extending downwardly from the inner edge 322 towards the outer edge 324. In yet other words. the screen-contacting face 318 slopes downwardly from the inner edge 322 towards the outer edge 324. The screen-contacting face 318 forms a first inclination angle $\alpha 1$ with a horizontal plane, as represented in FIG. 6, comprised between about 10° and about 60°, for instance comprised between about 20° and about 50°, for instance comprised between about 30° and about 40°. The angulation of the screen-supporting portion 320 is configured to contribute to flowing water away from the skylight protection assembly 100 as well as to contribute to the convexity of the protection screen 600 when mounted thereto.

In some embodiments, the length L1 of the first lateral frame member 300 is comprised between about 100 cm and about 300 cm. In some other embodiments, the length L1 is comprised between about 150 cm and about 250 cm. In yet some other embodiments, the length L1 is about 170 cm.

The first lateral frame member 300 comprises a deflector 326 located in the roof-mounting portion 310 and protruding outwardly with respect to an upper segment of the first lateral frame member 300. The deflector 326 protrudes outwardly from the outer side 312 (or outer face 312). The deflector 326 is shaped and dimensioned so that water flowing along an outer surface of the skylight protection assembly 100, and more particularly along the outer face 312 of the first lateral frame member 300 at an upper portion thereof (for instance at the screen-supporting portion thereof), will flow away from the skylight protection assembly 100, and thus will flow away from the protected skylight 12. The risk of water flowing through the skylight 12 is thus limited.

A sealing-receiving channel 328 is formed in the roof-mounting portion 310 of the first lateral frame member 300. Sealing-receiving channels could also be formed in any other one of the frame members of the frame 200.

In the embodiment shown, the sealing-receiving channel 328 extends upwardly from the roof-juxtaposable face 316, opens into the roof-juxtaposable face 316 and extends substantially along the entirety of the length L1 of the first lateral frame member 300. In some embodiments, the sealing-receiving channel 328 extends along at least about 30% of the length L1 of the first lateral frame member 300. In some other embodiments, the sealing-receiving channel 328 extends along at least about 50% of the length L1. In some other embodiments, the sealing-receiving channel 328 extends along at least about 70% of the length L1. In yet some other embodiments, the sealing-receiving channel 328 extends along at least about 90% of the length L1.

As represented in FIG. 6, the sealing-receiving channel 328 extends along a portion of a height hrm of the roof-mounting portion 310. In some embodiments, the sealing-receiving channel 328 extends along at least about 5% of the height hrm of the roof-mounting portion 310. In some other embodiments, the sealing-receiving channel 328 extends along at least about 10% of the height hrm. In some other embodiments, the sealing-receiving channel 328 extends along at least about 20% of the height hrm. In yet some other embodiments, the sealing-receiving channel 328 extends along at least about 30% of the height hrm.

Figure 5:
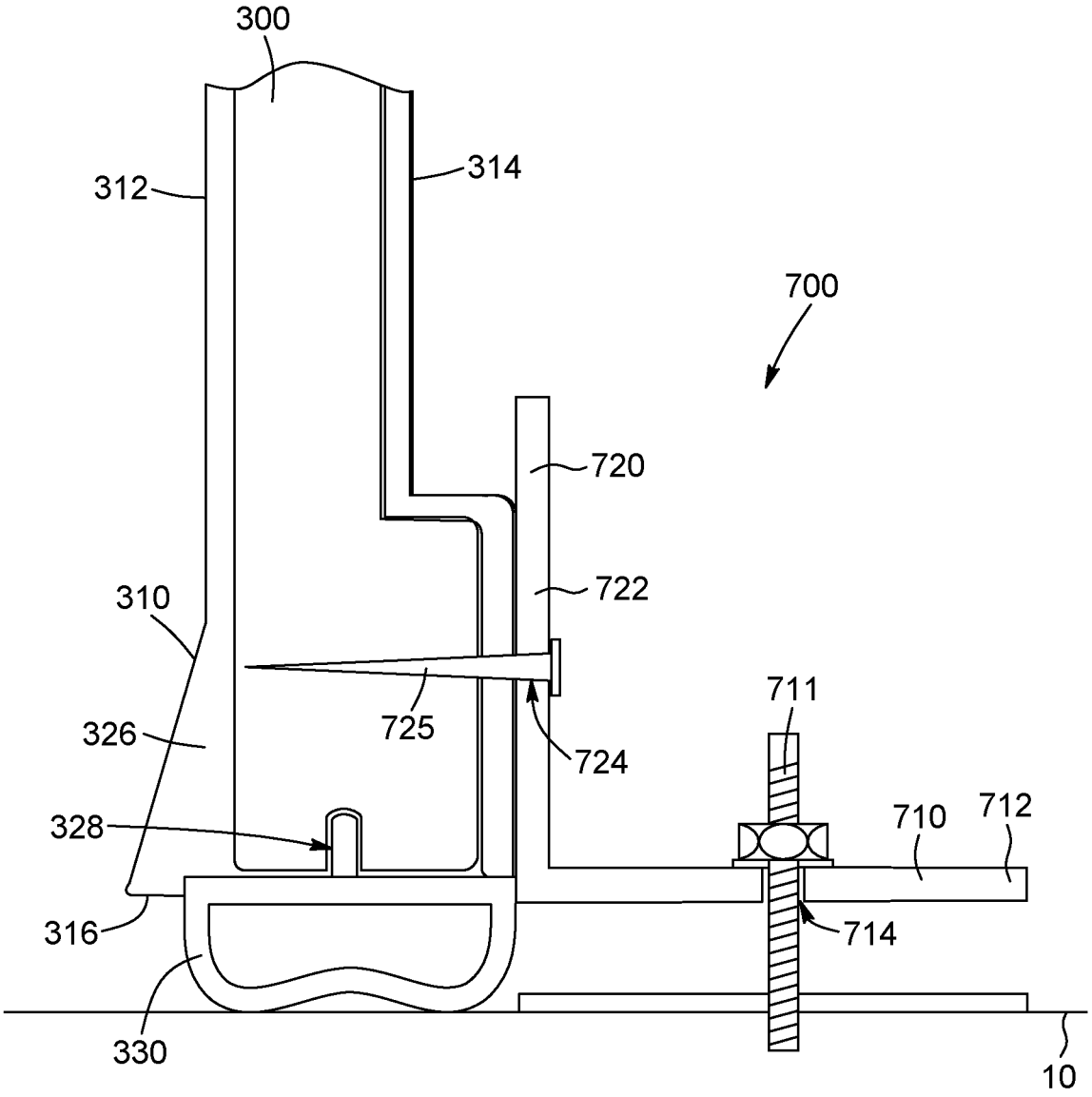
FIG. 5 is a cross-section view of a lateral frame member of the frame of FIG. 2 mounted to the roof connector of FIG. 4, the skylight protection assembly comprising a sealing joint mounted to the lateral frame member.

As represented in FIG. 5, the skylight protection assembly 100 further comprises a sealing joint 330 mounted to the first lateral frame member 300 and having a portion received in the sealing-receiving channel (or sealing-receiving aperture) 328, a portion of the sealing joint 330 extending along a portion of the length L1 of the roof-juxtaposable face 316 of the first lateral frame member 300. The sealing joint 330 is configured to form a tight sealing between the first lateral frame member 300 and the roof 10 when the first lateral frame member 300 is superposed thereto, a portion of the sealing joint 330 being sandwiched between the mounting surface 13 of the roof 10 and the roof-juxtaposable face 316 of the first lateral frame member 300. The sealing-receiving channel 328 with the sealing joint 330 received therein is configured to contribute to a tight sealing between the skylight protection chamber 610 and the outside thereof and contribute to efficiently protecting the skylight 12 covered by the skylight protection assembly 100.

Figure 25:
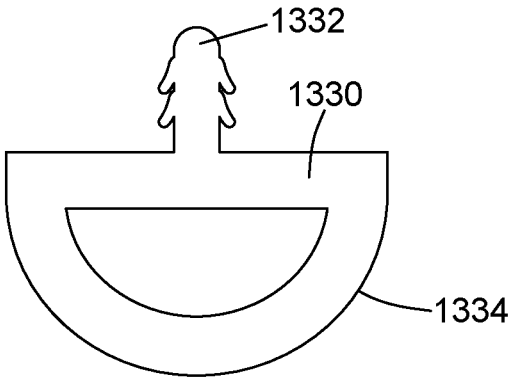
FIG. 25 is a cross-section view of another embodiment of a sealing joint.
Figure 26:
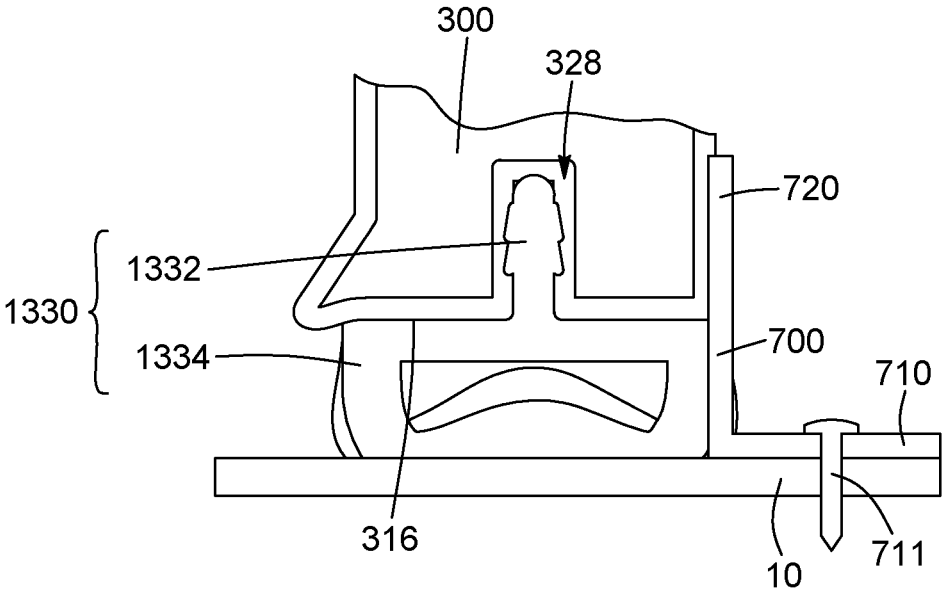
FIG. 26 is a cross-section of the sealing joint of FIG. 25 mounted to the lateral frame member of FIG. 5 and sandwiched between the lateral frame member and the mounting surface of the roof.

FIGS. 25 and 26 represent another possible embodiment of a sealing joint 1330. In the embodiment shown, the sealing joint 1330 comprises at least one channel-engaging portion 1332 (one or more channel-engaging pins 1332, in the embodiment shown) partially insertable into the sealing-receiving channel 328, and a sealing body 1334, having a substantially semi-spherical shape, in the embodiment shown, and protruding outwardly from the roof-juxtaposable face 316 of the first lateral member 300 when the one or more engaging pins 1332 are inserted into the sealing-receiving channel 328. As represented in FIG. 26, when the first lateral frame member 300 is superposed to the roof 10, the sealing joint 1330 forms a tight sealing between the first lateral frame member 300 and the roof 10, the sealing body 1334 being sandwiched between the mounting surface of the roof 10 and the roof-juxtaposable face 316 of the first lateral frame member 300.

As represented in FIG. 6, the first lateral frame member 300 further comprises a frame member body 311 extending between the roof-mounting portion 310 and the screen-supporting portion 320 and forming a junction therebetween.

In the embodiment shown, the first lateral frame member 300 has a width W1 in the roof-mounting portion 310, which is greater than a width W2 of the first lateral frame member 300 in the screen-supporting portion 320 and in the frame member body 311. In other words, a width of the first lateral frame member 300 (considered in a direction substantially perpendicular to the length L1 and substantially parallel to the sloping direction S when mounted to the roof 10) diverges towards the roof-mounting portion 310. The roof-mounting portion 310 can thus better resist the tensions applied thereto when mounted to the roof 10, for instance via roof connectors 700. Moreover, the roof-mounting portion 310 can thus be strongly fastened to the roof 10, and the risk for the frame 200 to be accidentally removed from the mounting surface of the roof 12 is thus limited.

In some embodiments, the roof-mounting portion 310 extends along more than about 5% of a height H1 of the first lateral frame member 300. In some other embodiments, the roof-mounting portion 310 extends along more than about 10% of the height H1 of the first lateral frame member 300. In yet some other embodiments, the roof-mounting portion 310 extends along about 15% of the height H1 of the first lateral frame member 300.

In some embodiments, the width W1 of the first lateral frame member 300 in the roof-mounting portion 310 is comprised between about 10 mm and about 45 mm. In some other embodiments, the width W1 is comprised between about 20 mm and about 30 mm. In yet some other embodiments, the width W1 is about 25 mm.

In some embodiments, the width W2 of the first lateral frame member 300 in the screen-supporting portion 320 is comprised between about 5 mm and about 35 mm. In some other embodiments, the width W2 is comprised between about 15 mm and about 25 mm. In yet some other embodiments, the width W2 is about 20 mm.

In some embodiments, the width W2 in the screen-supporting portion 320 is less than about 90% of the width W1 in the roof-mounting portion 310. In some other embodiments, the width W2 is less than about 80% of the width W1. In yet some other embodiments, the width W2 is about 75% of the width W1.

In the embodiment shown, the first lateral frame member 300 comprises a plane of symmetry extending substantially vertically and substantially perpendicularly to the longitudinal direction—or length L1—of the first lateral frame member 300.

Figure 8:
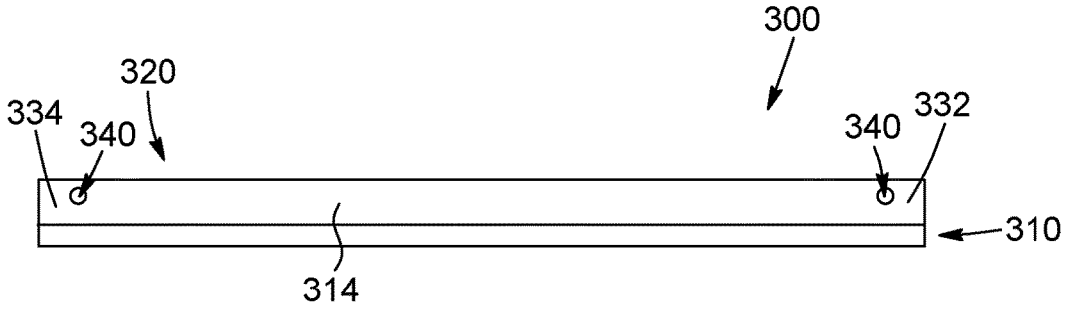

As represented in FIGS. 7 and 8, the outer face 312 and the inner face 314 of the first lateral frame member 300 both define a substantially rectangular periphery and their respective upper and lower edges extend substantially parallel to each other. In the embodiment shown, the screen-supporting portion 320 of the first lateral frame member 300 has a substantially flat profile considered along the length L1. In other words, the height H1 of the first lateral frame member 300 is substantially constant along the length L1 thereof. However, first and second lateral frame members 300, 300' having a substantially curved screen-supporting portion 320, or a screen-supporting portion 320 defining a slope, could also be conceived. In some embodiments, the height H1 of the first lateral frame member 300 is comprised between about 100 mm and about 300 mm. In some other embodiments, the height H1 is comprised between about 150 mm and about 250 mm. In yet some other embodiments, the height H1 is about 180 mm.

In some embodiments, the height hrm of the roof-mounting portion 310 is at least about 5% of the height H1 of the first lateral frame member 300. In some other embodiments, the height hrm of the roof-mounting portion 310 is at least about 10% of the height H1 of the first lateral frame member 300. In yet some other embodiments, the height hrm of the roof-mounting portion 310 is at least about 20% of the height H1 of the first lateral frame member 300.

Figure 15:
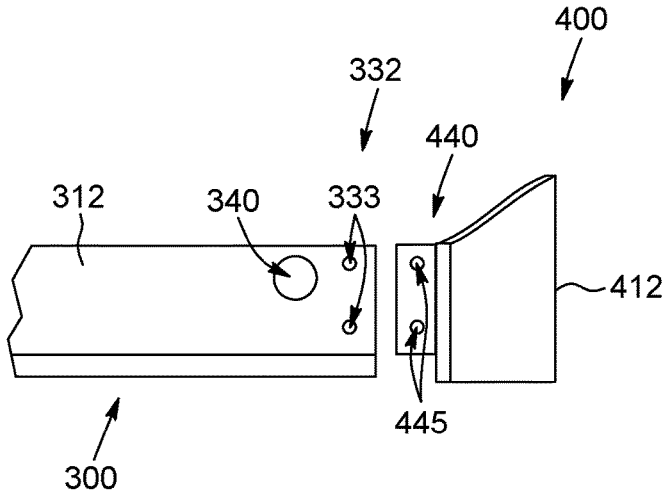
FIG. 15 is a side elevation view of the assembling end of FIG. 14, cooperating with an upper assembling end of the lateral frame member of FIG. 5.

The first lateral frame member 300 further comprises opposed first and second assembling end portions 332, 334 (or upper and lower longitudinal assembling end portions or upper and lower longitudinal assembling ends). As represented in FIG. 15, at least one air circulation opening 340 (or air circulation aperture 340) might be formed in the first lateral frame member 300, for instance in the screen-supporting portion 320 thereof. Similar or different air circulation apertures could be formed in all or part of the other frame members of the frame 200.

For instance and without being limitative, the air circulation opening 340 is located proximate one of the first and second assembling ends 332, 334 (proximate the upper longitudinal assembling end 332, in the embodiment shown so as to ensure air circulation in the skylight protection chamber 610 as it will described below, while avoiding entry of snow or water in the skylight protection chamber 610 via the air circulation opening 340) but the air circulation opening 340 could be located somewhere else in the first lateral frame member 300. The air circulation aperture 340 is thus shaped, arranged and dimensioned to allow a fluid circulation (such as an air circulation) between the skylight protection chamber 610 and the outside thereof. In some embodiments, the air circulation aperture 340 has a diameter comprised between about 1 inch and about 3 inches. In some other embodiments, the air circulation aperture 340 has a diameter of about 2 inches.

It is appreciated that the shape and the configuration of the first lateral frame member 300, as well as the shape and the configuration of its roof-mounting portion 310, its screen-supporting portion 320 and the shape, number and location of the air circulation opening 340 can vary from the embodiment shown.

Upper Frame Member

Referring now to FIGS. 2 and 3, there is shown that the upper frame member 400 is configured to be mounted upwardly with regards to the lower frame member 500, when the skylight protection assembly 100 is mounted to a sloping roof. With reference to FIGS. 9 to 11 and 13 to 15, the upper frame member 400 has an outer face 412, and an opposed inner face 414 facing the skylight protection chamber 610 when the skylight protection assembly 100 is assembled and when the protection screen 600 is mounted to the frame 200.

Figure 14:
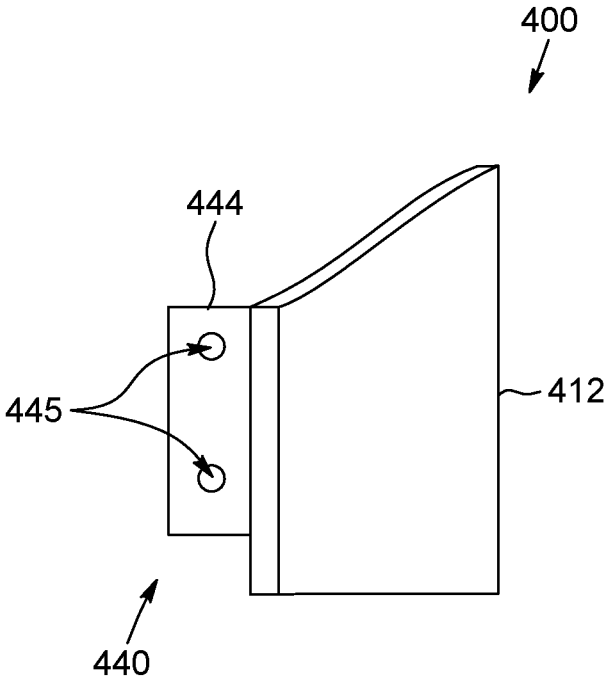
FIG. 14 is a side elevation view of the assembling end of FIG. 13.

The upper frame member 400 has a length L2 and opposed assembling ends 440, 442 removably engageable respectively with the upper assembling ends 332 of the first and second lateral frame members 300, 300'. In the embodiment shown, each of the assembling ends 440, 442 has an assembling groove 448, 450 (See FIG. 11) configured and dimensioned to receive at least partially the upper assembling ends of the first and second lateral frame members 300, 300', and a fastening flange 444, 446 protruding from the inner face 414. The fastening flanges 444, 446 are adjacent a respective one of the assembling grooves, therefore when the upper assembling ends 332 of the first and second lateral frame members 300, 300' are inserted in a corresponding one of the assembling grooves 448, 450, the fastening flanges 444, 446 abut against the inner face 314 of the corresponding one of the first and second lateral frame members 300, 300'. Therefore, the upper frame member 400 is secured to the first and second lateral frame members 300, 300' by bolts, screws or any other suitable mechanical fasteners configured to attach the fastening flanges 444, 446 of the upper frame member 400 to the upper assembling ends of the first and second lateral frame members 300, 300'. To this end, fastening apertures 445, as represented in FIGS. 14 and 15, could be formed in the fastening flanges 444, 446 of the assembling ends 440, 442. When assembled together, the fastening apertures 445 are substantially aligned with corresponding fastening apertures 333 formed in the upper assembling ends 332 of the first and second lateral frame members 300, 300'. It is appreciated that any other mounting assemblies configured to removably or permanently secure the upper frame member 400 to the first and second lateral frame members 300, 300' could also be conceived.

Similarly to the above-described first and second lateral frame members 300, 300', the screen-supporting portion 420 of the upper frame member 400 has a screen-contacting face 418 comprising an inner edge 422 and an outer edge 424; the screen-contacting face 418 is angled downwardly from the inner edge 422 towards the outer edge 424.

Figure 10:
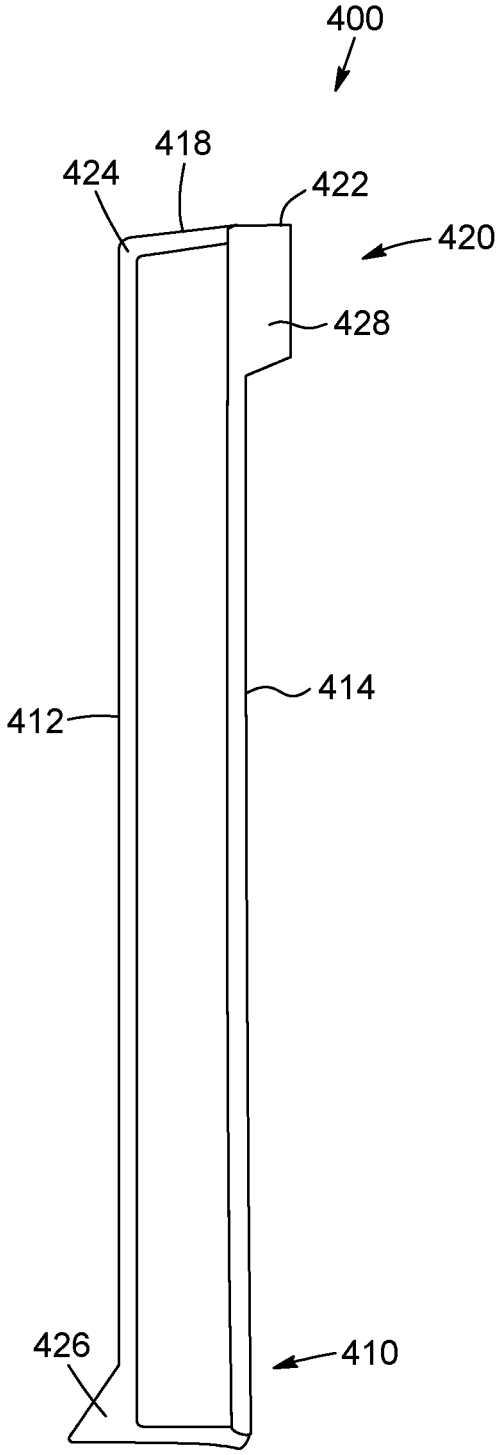
FIG. 10 is a cross-section view of the upper frame member of FIG. 9.
Figure 11:
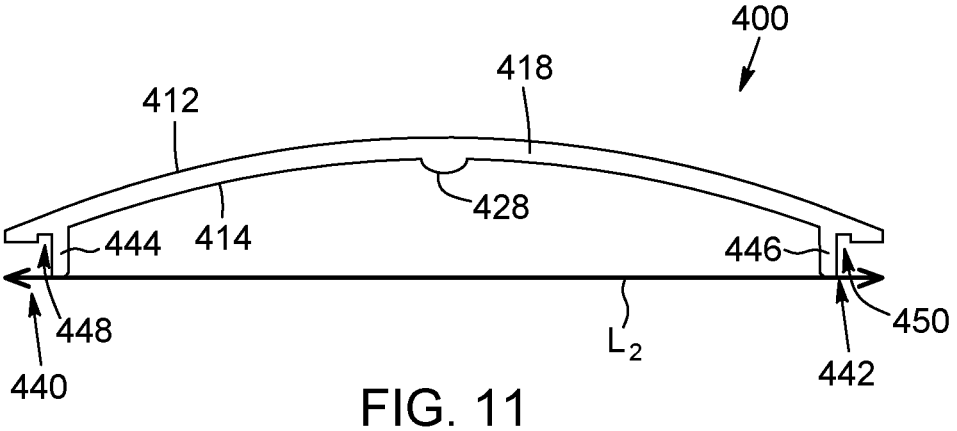
FIG. 11 is a top elevation view of the upper frame member of FIG. 9.
Figure 12:
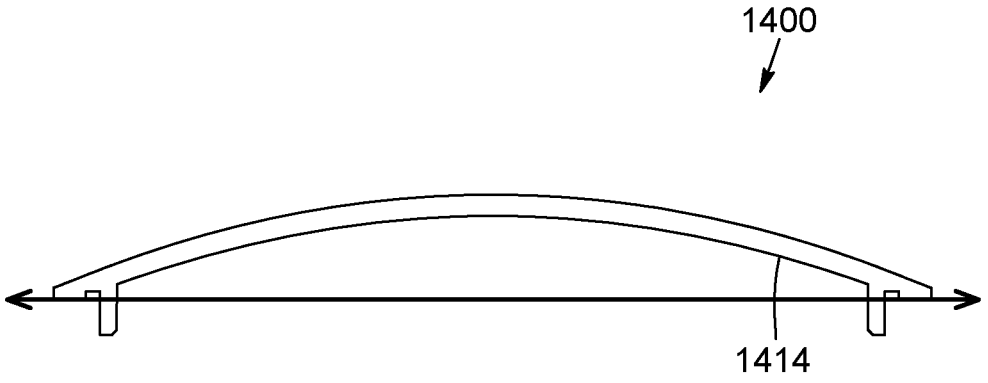
FIG. 12 is a top elevation view of an upper frame member in accordance with another embodiment.
Figure 13:
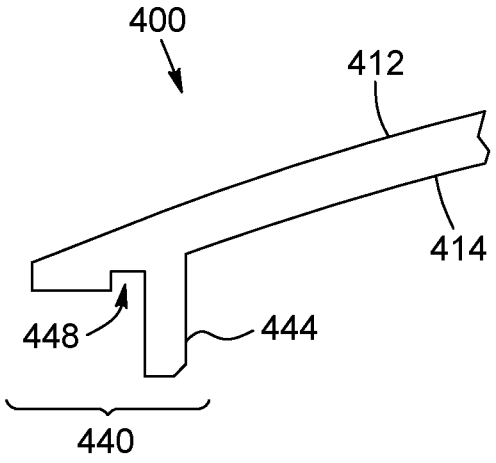
FIG. 13 is a top elevation view of an assembling end of the upper frame member of FIG. 9.

As shown in FIGS. 10 and 11, the upper frame member 400, in the screen-supporting portion 420 thereof, might further comprise a centering support protrusion 428 protruding inwardly from the inner face 414 of the upper frame member 400. In the embodiment shown, the centering support protrusion 428 extends along a central portion of the upper frame member 400, (i.e. substantially centrally considered along the length L2 of the upper frame member 400), but it could be located elsewhere. The centering support protrusion 428 is configured and shaped to contribute to the centering of the protection screen 600 when mounted thereto and ease the mounting (or securing) of the protection screen 600 to the screen-supporting portion 210 of the frame 200. As represented in FIG. 12, it could also be conceived an upper frame member 1400 having no centering support protrusion that would protrude from the inner face 1414 thereof.

As mentioned above, the screen-supporting portion 420 of the upper frame member 400 is outwardly curved (i.e. has a substantially convex profile towards the outside of the skylight protection chamber 610 considered in a plane transversal, for instance substantially perpendicular, to the mounting surface 13 of the roof 10). In other words, in the embodiment shown, the upper frame member 400 is substantially arched towards the outside of the skylight protection chamber 610, considered in a plane substantially perpendicular to the roof 10 when the frame 200 is mounted thereto. In yet other words, a height H2 of the upper frame member 400 at the first and second assembling ends 440, 442 is shorter than a height H3 in a central portion of the upper frame member 400. In the embodiment shown, the height H2 represents less than about 90% of the height H3. In another embodiment, the height H2 represents less than about 80% of the height H3. In another embodiment, the height H2 represents less than about 70% of the height H3. In yet another embodiment, the height H2 represents less than about 60% of the height H3.

In some embodiments, the radius of curvature of the screen-supporting portion 420 of the upper frame member 400 is comprised between about 30 inches and about 150 inches. In some other embodiments, the radius of curvature of the screen-supporting portion 420 of the upper frame member 400 is comprised between about 50 inches and about 130 inches. In some other embodiments, the radius of curvature of the screen-supporting portion 420 of the upper frame member 400 is comprised between about 75 inches and about 100 inches. In some other embodiments, the radius of curvature of the screen-supporting portion 420 is comprised between about 80 inches and about 95 inches. In some other embodiments, the radius of curvature of the screen-supporting portion 420 is comprised between about 84 inches and about 88 inches. In yet some other embodiments, the radius of curvature of the screen-supporting portion 420 is about 86½ inches.

In some embodiments, the height H2 is comprised between 150 mm and about 200 mm. In some other embodiments, the height H2 is about 180 mm. In some embodiments, the height H3 is comprised between about 200 mm and about 300 mm. In some other embodiments, the height H3 is comprised between about 230 mm and about 260 mm. In yet some other embodiments, the height H3 is about 245 mm.

In the embodiment shown, a substantially arcuated shape is formed between the first and second assembling ends 440, 442. However, an upper frame member 400 having a screen mounting portion 420 with a different non-planar shape, for instance two straight slopes joining at the central portion thereof, could also be conceived.

Moreover, as represented in FIG. 10, the upper frame member 400 comprises a deflector 426 located in the roof-mounting portion 410 and protruding outwardly from the outer face 412 (or outer side 412) with respect to an upper portion of the upper frame member 400 (for instance with respect to the screen-supporting portion 420 thereof). The deflector 426 promotes water to flow away from the outer face 412 of the upper frame member 400.

Figure 23:
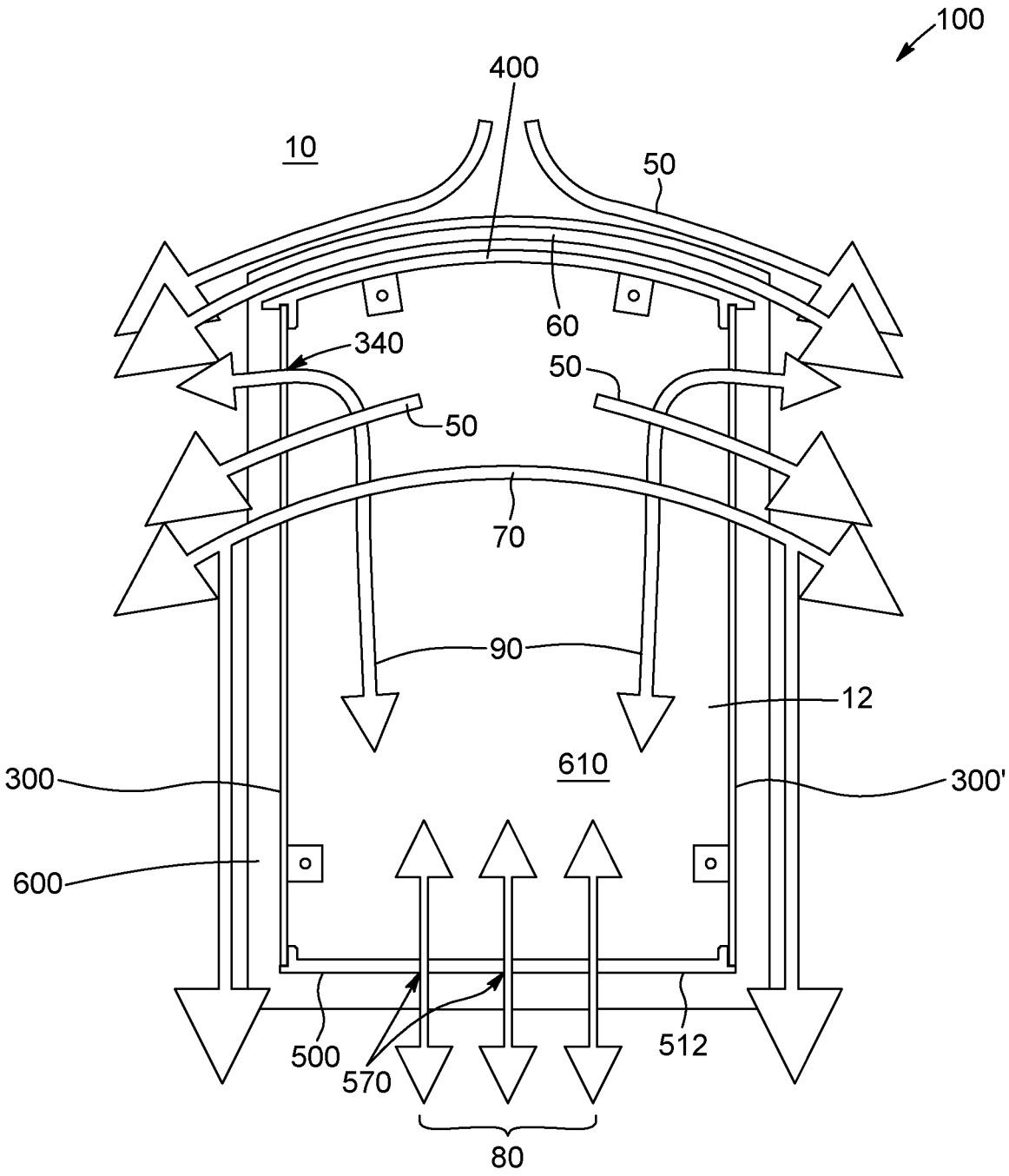
FIG. 23 is a schematic representation of circulation of fluids on and in one of the skylight protection assemblies of FIG. 1.
Figure 24:
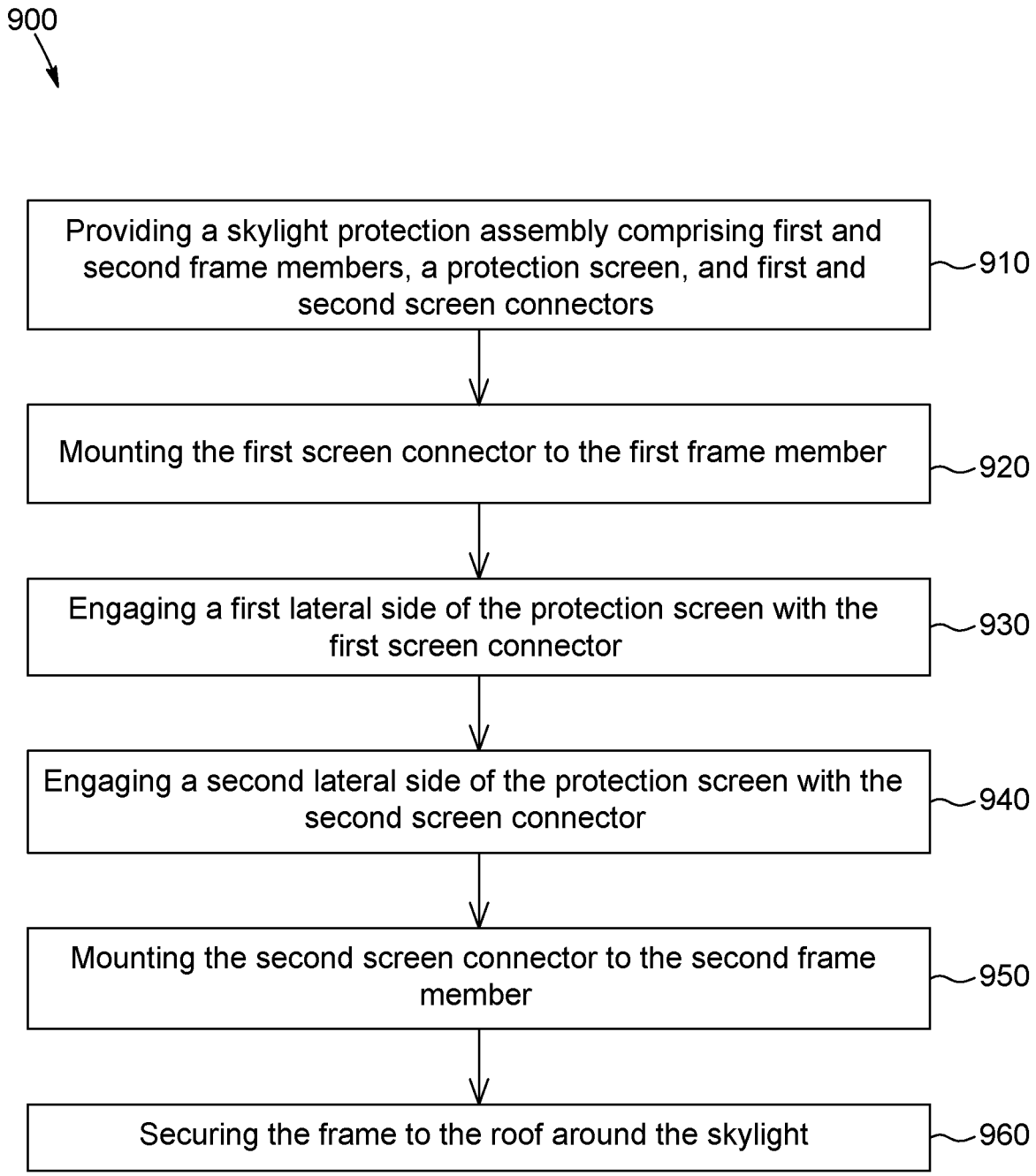
FIG. 24 is a block diagram representing the different steps of a method for protecting a skylight of a roof.

In the embodiment shown, and as represented in FIGS. 11 and 13 to 15, the upper frame member 400 is moreover substantially arched towards the outside of the skylight protection chamber 610, considered in a plane substantially parallel to the mounting surface of the roof 10 when the frame 200 is mounted thereto. In other words, the outer side 412 (or outer face 412) of the upper frame member 400 has a substantially convex profile towards the outside of the skylight protection chamber 610. In the embodiment shown, the radius of curvature of the outer side 412 of the upper frame member 400 is comprised between about 40 inches and about 65 inches. In some other embodiments, the radius of curvature of the outer side 412 is comprised between about 45 inches and about 60 inches. In some other embodiments, the radius of curvature of the outer face 412 is comprised between about 49½ inches and about 55¼ inches. In yet some other embodiments, the radius of curvature of the outer side 412 is about 53½ inches. As represented in FIG. 23, it is thus understood that the upper frame member 400 is configured and shaped for water flowing down the roof, as represented by arrows 50, 60, to flow away from the skylight protection assembly 100, and thus flow away from the protected skylight 12. In other words, the outer side 412 of the upper frame member 400 has a water-flowing profile considered in a plane substantially parallel to the mounting surface 13 of the roof 10.

In the embodiment shown, the above-mentioned inner side 414 (or inner face 414) extends substantially parallel to the outer side 412, so that the inner side 414 has a substantially concave profile towards the skylight protection chamber 610. An upper frame member 400 having non-parallel outer and inner sides 412, 414 could also be conceived; for instance, the inner side 414 could be substantially planar, so that a screen-contacting face 418 of the upper frame member 400 extending between the outer and inner sides 412, 414 would comprise a surface area greater than a surface area of the screen-contacting face 418 of the embodiments illustrated in FIGS. 11 and 12.

As represented in FIG. 11, the upper frame member 400 has a plane of symmetry extending substantially vertically and substantially perpendicularly to the length L2 of the upper frame member 400.

It is appreciated that the shape and the configuration of the upper frame member 400, 1400 can vary from the embodiments shown. Moreover, it is to be noted that, in the embodiment shown, the upper frame member 400 is free from any air circulation apertures/air circulation window.

Lower Frame Member

The lower frame member 500 is configured to be mounted downwardly with regards to the upper frame member 400, when the skylight protection assembly 100 is mounted to a sloping roof. With reference to FIGS. 16, 18, 20 and 21, the lower frame member 500 has an outer face 512 (or outer side 512), and an opposed inner face 514 (or inner side 514) facing the skylight protection chamber 610 when the skylight protection assembly 100 is assembled.

Figure 17:
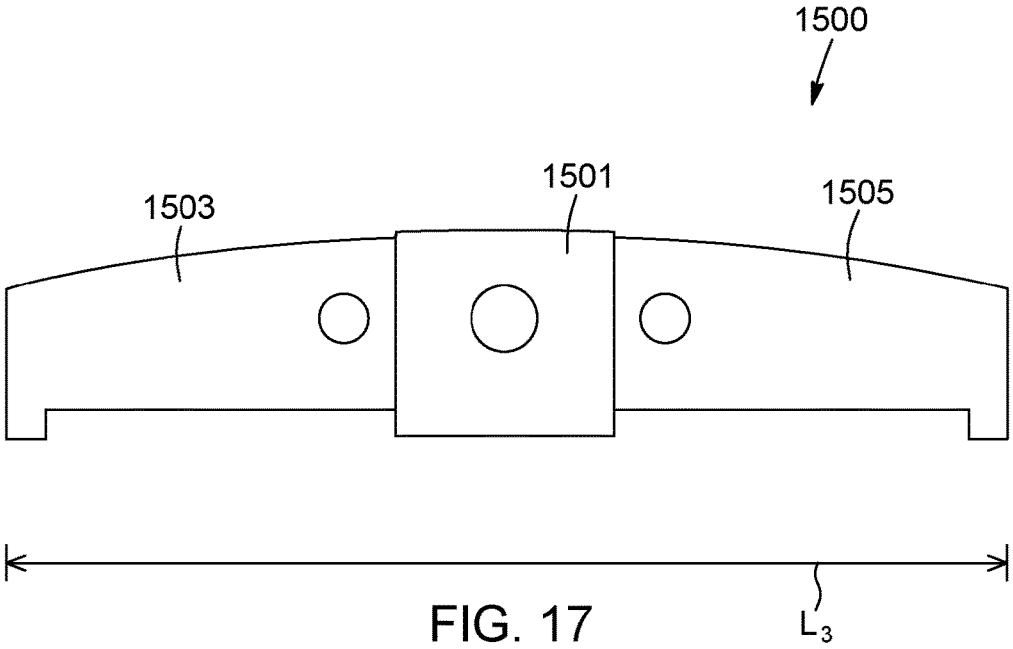
FIG. 17 is a front elevation view of a lower frame member in accordance with another embodiment.

The lower frame member 500 has a length L3 (substantially equal to the length L2 of the upper frame member 400 in the embodiment shown) and opposed assembling ends 540, 542 removably securable respectively to the lower assembling ends 334 of the first and second lateral frame members 300, 300'. The lower frame member 500, similarly to the other frame members of the frame 200, can be formed of a single element, as represented in FIG. 16, or could alternatively be formed a plurality of assembled components. For instance, the lower frame member 1500 in accordance with another embodiment, as represented in FIG. 17, could comprise a central frame component 1501 mounted between two lateral frame components 1503, 1505. Lower frame members having different lengths L3 could thus easily be produced by replacing one or more of the different frame components 1501, 1503, 1505.

In some embodiments, the length L3 of the lower frame member 500 is comprised between about 500 mm and about 1500 mm. In some other embodiments, the length L3 is comprised between about 900 mm and about 1200 mm. In yet some other embodiments, the length L3 is about 1000 mm.

Figure 21:
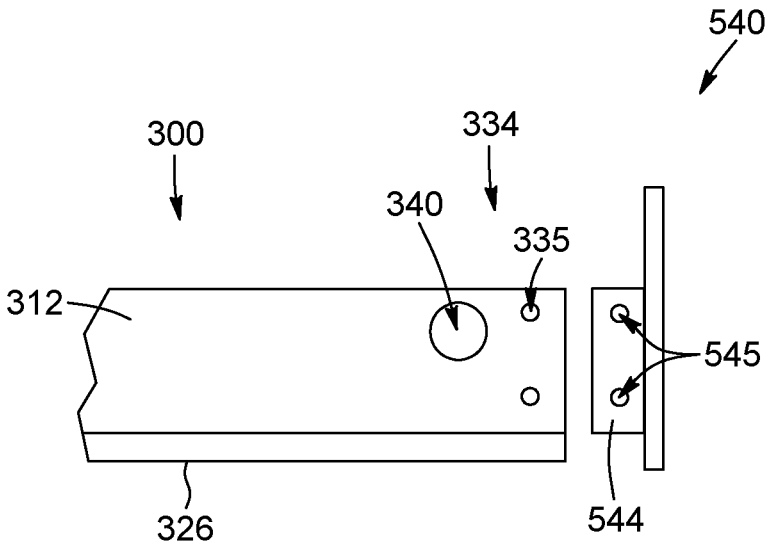
FIG. 21 is a side elevation view of the assembling end of FIG. 20, cooperating with a lower assembling end of the lateral frame member of FIG. 5.

In the embodiment shown, each of the first and second assembling ends 540, 542 of the lower frame member 500 has a fastening flange 544, 546 engageable with a portion of the lower assembling ends of the first and second lateral frame members 300, 300' to removably secure the lower frame member 500 to the first and second lateral frame members 300, 300'. The lower frame member 500 is further secured to the first and second lateral frame members 300, 300' by bolts, screws or any other suitable mechanical fasteners assembling together the fastening flanges 544, 546 to the lower assembling ends of the first and second lateral frame members 300, 300'. When the lower frame member 500 is mounted to the first and second lateral frame members 300, 300', the fastening flanges 544, 546 abut against the inner face 314 of the corresponding one of the first and second lateral frame members 300, 300'. To this end, fastening apertures 545, 335 as represented in FIG. 21, could be formed in the fastening flanges 544, 546 and in the lower assembling ends 334 of the first and second lateral frame members 300, 300' facing each other and aligned with each other when the fastening flanges 544, 546 are superposed to the lower assembling ends, inwardly thereof. Any other mounting assemblies configured to removably or permanently mount the lower frame member 500 to the first and second lateral frame members 300, 300' could also be conceived.

Similarly to the above-described upper frame member 400, a screen-contacting face 518 of the screen-supporting portion 520 of the lower frame member 500 might be angled downwardly from an inner edge towards an outer edge, for water to flow away from the screen-contacting face 518 of the lower frame member 500.

Figure 19:
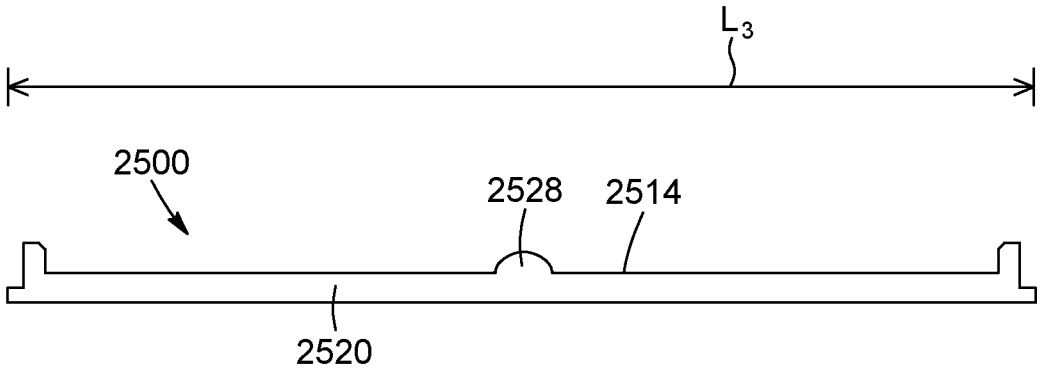
FIG. 19 is a top elevation view of a lower frame member in accordance with another embodiment.
Figure 20:
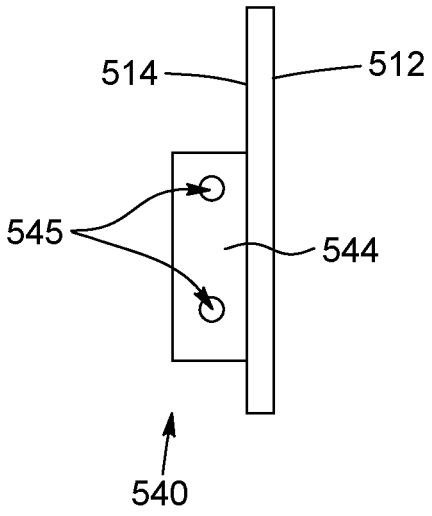
FIG. 20 is a side elevation view of an assembling end of the lower frame member of FIG. 16.

As represented in FIG. 19, in accordance with another embodiment, the lower frame member 2500 might further comprise in the screen-supporting portion 2520, a centering support protrusion 2528 protruding inwardly from the inner face 2514 thereof. In the embodiment shown, the centering support protrusion 2528 is formed substantially centrally considered along the length L3 of the lower frame member 2500, but it could be located elsewhere. The centering support protrusion 2528 is configured and shaped to contribute to the centering of the protection screen 600 and ease the mounting (or securing) of the protection screen 600 to the screen-supporting portion 2520 of the lower frame member 2500.

As mentioned above, the screen-supporting portion 520 of the lower frame member 500 is outwardly curved (i.e. has a substantially convex profile towards the outside of the skylight protection chamber 610 in a plane substantially perpendicular to the mounting surface of the roof 10). In other words, in the embodiment shown, the lower frame member 500 is substantially arched towards the outside of the skylight protection chamber 610, considered in a plane substantially perpendicular to the roof 10 when the frame 200 is mounted thereto. In yet other words, a height H4 of the lower frame member 500 at the first and second assembling ends 540, 542 is shorter than a height H5 in a central portion of the lower frame member 500. In the embodiment shown, the height H4 represents less than about 90% of the height H5. In another embodiment, the height H4 represents less than about 80% of the height H5. In another embodiment, the height H4 represents less than about 70% of the height H5. In yet another embodiment, the height H4 represents less than about 60% of the height H5.

In some embodiments, the radius of curvature of the screen-supporting portion 520 of the lower frame member 500 is comprised between about 30 inches and about 150 inches. In some other embodiments, the radius of curvature of the screen-supporting portion 520 of the lower frame member 500 is comprised between about 50 inches and about 130 inches. In some other embodiments, the radius of curvature of the screen-supporting portion 520 of the lower frame member 500 is comprised between about 75 inches and about 100 inches. In some other embodiments, the radius of curvature of the screen-supporting portion 520 is comprised between about 80 inches and about 95 inches. In some other embodiments, the radius of curvature of the screen-supporting portion 520 is comprised between about 84 inches and about 88 inches. In yet some other embodiments, the radius of curvature of the screen-supporting portion 520 is about 86½ inches.

In some embodiments, the height H4 at the first and second assembling ends is comprised between 150 mm and about 200 mm. In some other embodiments, the height H4 is about 180 mm. In some embodiments, the height H5 at the central portion is comprised between about 200 mm and about 300 mm. In some other embodiments, the height H5 is comprised between about 230 mm and about 260 mm. In yet some other embodiments, the height H5 is about 245 mm.

In the embodiment shown, a substantially arcuated shape is formed between the first and second assembling ends 540, 542. However, an upper frame member 500 having a screen mounting portion 520 with a different non-planar shape, for instance two straight slopes joining at the central portion could also be conceived.

In the embodiment shown, the upper and lower frame members 400, 500 have a substantially similar radius of curvature, but a frame 200 with upper and lower frame members 400, 500 having different radii of curvature could also be conceived.

Moreover, the upper frame member 500, in the roof-mounting portion 510, might further comprise a deflector (not represented) protruding outwardly from the outer side 512 thereof, for water to flow away from an upper portion of the outer face 512 of the lower frame member 500.

Figure 18:
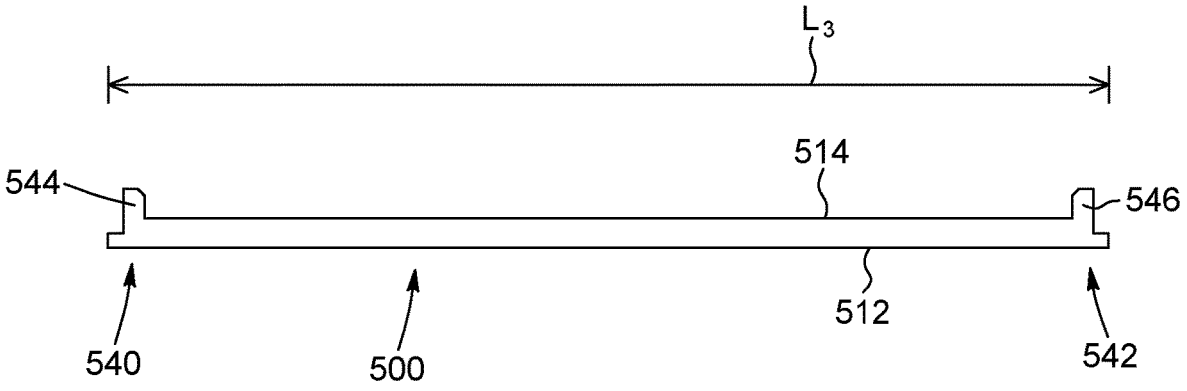
FIG. 18 is a top elevation view of the lower frame member of FIG. 16.

In the embodiment shown, and as represented in FIG. 18, the opposed outer and inner sides 512, 214 (or outer and inner faces 512, 514) are substantially planar and extend substantially parallel to each other. A lower frame member 500 with inner and outer sides 514, 512 with different shapes could however also be conceived.

As represented in FIG. 16, air circulation openings 570 (or air circulation apertures 570) are formed in the lower frame member 500. For instance, and without being limitative, the air circulation openings 570 comprise through openings formed between the roof-mounting portion 510 and the screen-supporting portion 520, and between the first and second assembling ends 540, 542, substantially centrally in the lower frame member 500. The air circulation apertures might further comprise air circulation windows 572 formed in the roof-mounting portion 510 (for instance an air circulation indent 572 formed in a lower edge portion of the roof-mounting portion 510) and defining air circulation openings between the mounting surface 13 of the roof 10 and the frame 200, when the frame 200 is mounted thereto.

In the embodiment shown, the two air circulation windows 572 (or two spaced-apart air circulation idents) are separated from each other by a central roof-mounting portion 573 (or central roof-mounting base 573). It is appreciated that the shape, the number, the configuration, and the location of the air circulation apertures 570 comprising the through openings and the air circulation windows 572 can vary from the embodiment shown.

As represented in FIG. 16, the lower frame member 500 has a plane of symmetry extending substantially vertically and substantially perpendicularly to the length L3 of the lower frame member 500.

It is appreciated that the shape and the configuration of the lower frame member 500, 1500, 2500 can vary from the embodiments shown.

Structure of the Frame

In the embodiment shown, the different frame members 300, 300',400, 500 of the frame 200 have a similar construction (or structure), so that the following description of the construction (or structure) of the first lateral frame member 300, with reference to FIG. 6, will also apply to any of the other frame members of the frame 200.

The first lateral frame member 300 is of a sandwich construction. It includes a central core 317 sandwiched between an inner layer 315, forming the inner face 314 (or inner side 314), and an outer layer 313, forming the outer face 312 (or outer side 312).

In the embodiment shown, the inner and outer layers 315, 313 are at least partially made of polyester or any other polymer having impermeability and resistance properties (i.e. a water-resistant polymer). In the embodiment shown, the outer layer 313 is at least partially made of a polyester material (such as, for instance and without being limitative, Gelcoat™ or other thermosetting polymers based on epoxy or unsaturated polyester resin chemistry) and of laminated glass fiber, for instance polyester injected glass fiber. In the embodiment shown, the inner layer 315 is at least partially made of laminated polyester and of Gelcoat™ (or other thermosetting polymers based on epoxy or unsaturated polyester resin chemistry).

In the embodiment shown, the central core 317 is at least partially made of PVC or any other material having a density greater than a density of the inner and outer layers 315, 313. In the embodiment shown, the central core 317 is at least partially made of compressed recycled PVC (such as, and without being limitative Armacell ArmaForm® GR 250 PET foam core).

In some embodiments, the central core 317 extends along at least about 40% of the width W2 of the first lateral frame member 300. In some other embodiments, the central core 317 extends along at least about 50% of the width W2 of the first lateral frame member 300. In yet some other embodiments, the central core 317 extends along at least about 65% of the width W2 of the first lateral frame member 300.

In the embodiment shown, the first lateral frame member 300 is made by polyester materials cold pressing and high-pressure injection.

The outer face 312 might comprise a light-capturing material (such as a dark—for instance black—material) for the outer face 312 of the first lateral frame member 300 to contribute to the melding of snow covering the roof 10 around the skylight 12 and/or the skylight protection assembly 100.

The inner face 314 might comprise a light-reflecting material (such as a clear—for instance white—material) for the inner face 314 to allow more light to reach the skylight 12.

It is appreciated that the structure, the composition and the arrangement of the different materials forming the first lateral frame member 300, as well as the other frame members 300', 400, 500, can vary from the embodiment shown.

Protection Screen

In the embodiment shown, the protection screen 600 is substantially dome-shaped when mounted to the frame 200. The protection screen 600 is thus shaped and configured for snow, water or any other element reaching an outer surface of the protection screen 600 to slide away from the protection screen 600. In other words, the protection screen 600 prevents any object or weather element from stagnating on the outer surface of the protection screen 600.

As represented in FIG. 1, the protection screen 600 might have a surface area greater than a surface area delimited by the frame 200. In other words, the protection screen 600 might be dimensioned to extend outwardly beyond the outer periphery 14 of the frame 200. The protection screen 600 contributes to the flowing of water or any other element away from the protection skylight 12.

The protection screen 600 is made of a transparent or translucid material or any other material allowing light to reach the protected skylight 12. For instance and without being limitative, the protection screen 600 is at least partially made of polycarbonate, such as Lexan®.

Screen Connectors

The skylight protection assembly 100 further comprises at least one screen connector 800 configured to removably mount (or secure) the protection screen 600 to the frame 200, and more particularly to the screen-supporting portion 220 of the frame 200.

With reference to FIGS. 22A, 22B, 22C and 22D, the screen connector 800 comprises in the embodiment shown a frame-mounting portion 810 (or connecting portion) configured to removably mount the screen connector 800 to the frame 200, and more particularly to the screen-supporting portion 220 thereof. In the embodiment shown, the frame-mounting portion 810 comprises a mounting plate 812 with apertures 814 formed therein configured to secure the screen connector 800 to a face of one of the frame members 300, 300', 400 and 500 (to outer faces of the first and second lateral frame members 300, 300' in the embodiment shown in FIG. 1).

The screen connector 800 further comprises a screen-receiving portion 820 extending in the embodiment shown substantially perpendicularly to the frame-mounting portion 810. A screen engagement slot 822 is formed in the screen-receiving portion 820 that is dimensioned to receive a portion of a peripheral border of the protection screen 600. The screen engagement slot 822 might have a width W3 greater than a thickness of the protection screen 600, to allow some expansion of the protection screen 600 when removably engaged therein. In the embodiment shown, the screen-receiving portion 820 comprises a distal end 824 extending inwardly (with respect to the skylight protection chamber 610) from the frame 200 when the screen connector 800 is mounted thereto, for the protection screen 600 to be maintained in the screen engagement slot 822.

For instance, and without being limitative, the skylight protection assembly 100 comprises at least two screen connectors 800 removably securable to opposed frame members (for instance to the first and second lateral frame members 300, 300'). The protection screen 600 is furthermore mounted to the frame 200 by the cooperation of (for instance the engagement with) the protection screen 600 to the centering support protrusions 428, 2528 of the upper and lower frame members 400, 2500.

It is appreciated that the shape, the configuration, the number and the location of the screen connectors 800, and particularly the shape, the configuration and the location of the frame-mounting portion 810 and the screen-receiving portion 820 can vary from the embodiment shown.

Roof Connectors

Figure 4:
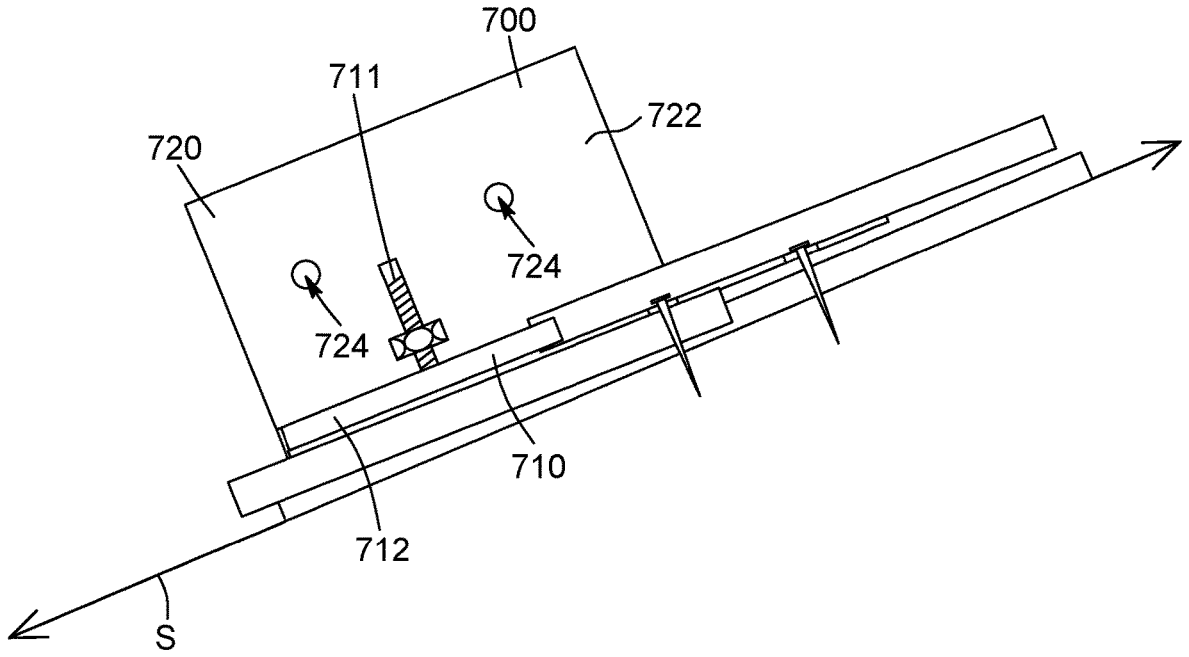
FIG. 4 is a side elevation view of a roof connector in accordance with an embodiment, to removably mount the frame of FIG. 2 to the roof.

As represented in FIGS. 4 and 5, the skylight protection assembly 100 further comprises, in the embodiment shown, at least one roof connector 700 removably securable to the roof 10 and removably securable to the roof-mounting portion 210 of at least one of the frame members, for instance to the roof-mounting portion 310 of at least one of the first and second lateral frame members 300, 300' (for instance to inner faces thereof, in the embodiment shown). A skylight protection assembly 100 having roof connectors removably engageable with at least one of the upper and lower frame members 400, 500 could also be conceived, as represented in FIG. 3.

With reference to FIGS. 3 to 5, the roof connector 700 comprises a roof-mounting portion 710 comprising, in the embodiment shown, a roof-mounting plate 712 with apertures 714 formed therein to removably secure the roof connector 700, for instance with screws 711, bolts or any other suitable mechanical fastener, to the roof 10.

The roof connector 700 further comprises a frame-mounting portion 720 configured to removably secure the roof connector 700 to the frame 200 (to the first lateral member 300, in the embodiment shown). For instance, the frame-mounting portion 720 comprises a frame-mounting plate 722 extending transversally, for instance perpendicularly, to the roof-mounting portion 710, with apertures 724 formed therein to removably secure the roof connector 700, for instance with nails 725, screws, bolts or any other suitable mechanical fastener, to the frame 200.

It is appreciated that the shape, the configuration, the number and the location of the roof connector 700, and particularly the shape, the configuration and the location of the roof-mounting portion 710 and the frame-mounting portion 720 can vary from the embodiment shown.

Kit for Forming a Skylight Protection Assembly

According to another aspect of the disclosure, there is provided a kit for forming a skylight protection assembly 100 according to the present disclosure. In the shown embodiment, the kit comprises all or any part of the first and second lateral frame members 300, 300', the upper frame member 400, the lower frame member 500, the protection screen 600, at least one screen connector 800 to removably mount (or secure) the protection screen 600 to the frame 200 formed by the assembly of the different frame members 300, 300', 400, 500, and at least one roof connector 700 to removably mount (or secure) the frame 200 to the roof 10 with the skylight 12 to be protected formed therein.

Method for Protecting a Skylight of a Roof

According to yet another aspect of the disclosure, there is provided a method 900 for protecting a skylight of a roof. The method 900 according to embodiments of the present disclosure may be carried out with a skylight protection assembly 100 as the ones described above.

The method 900 firstly comprises a step 910 of providing a skylight protection assembly 100 comprising first and second frame members 300, 300', 400, 500 having a roof-engaging portion and a screen-supporting portion, a protection screen 600, and first and second screen connectors 800 comprising a frame-mounting portion 810 and a screen-receiving portion 820.

The method 900 then comprises a step 920 of mounting—or securing—the frame-mounting portion 810 of the first screen connector 800 to the screen-supporting portion of the first frame member. The method 900 further comprises a step 930 of engaging a first lateral side of the protection screen 600 in a screen engagement slot 822 formed in the screen-receiving portion 820 of the first screen connector 800. The method further comprises a step 940 of engaging a second lateral side of the protection screen 600 with the screen-receiving portion 820 of the second screen connector 800, a step 950 of mounting—or securing—the frame-mounting portion 810 of the second screen connector 800 to the second frame member; and a step 960 of securing the frame to the roof around the skylight.

It is thus understood that the protection screen 600 can be mounted to the frame 200 by being progressively tensed and arched, so as to limit the risk of breaking the protection screen 600.

The step 960 of securing the frame to the roof around the skylight might further comprise, as represented in FIG. 3, a step of mounting the frame 200 to rafters 15 of the roof 10—for instance via the above-described roof connectors 700—for the skylight protection assembly 100 to further resist blasts of wind.

It is understood that the step of securing the frame to the roof might be performed after or before the steps of engaging the first and second lateral sides of the protection screen to the first and second screen connectors and mounting the first and second screen connectors to the frame. In other words, the protection screen can either be engaged to the frame 200 prior to the securing of the frame 200 with the protection screen 600 engaged therewith to the roof, or the protection screen 600 can be engaged with the frame 200 once the frame 200 has been mounted to the roof. However, it is understood that, in the embodiment in which roof connectors are mounted to inner faces of the frame members, the step of securing the frame to the roof would more likely be performed before engaging the first and second lateral sides of the protection screen to the first and second screen connectors and mounting the first and second screen connectors to the frame.

The skylight protection assembly 100 can thus easily be mounted to the roof 10, so as to provide a light and efficient protection to the skylight 12. The skylight protection assembly 100 can for instance be removably mounted in the fall, to protect the skylight 12 during the winter, and then be removed in the springs, without either the roof 10 or the skylight 12 to be deteriorated. Moreover, the skylight protection assembly 100 is dimensioned and shaped to allow at least a partial opening of the protected skylight 12. Moreover, the dimensions of the frame 200 and the protection screen 600 can be easily modified for the skylight protection assembly 100 to be adapted to different types of skylights 12 and/or different types of roofs 10.

As represented in FIG. 25 by arrows 50, 60, 70, a fluid, such as water or snow, reaching an upper portion (the outer face 412 of the upper frame member 400 and the outer face of the protection screen 600, in the embodiment shown) of the skylight protection assembly 100 flows away from the protected skylight 12 due to the above-described curved shapes of the frame 200 (and more particularly in the embodiment shown of the upper frame member 400) and of the protection screen 600.

Moreover, as represented by arrows 80, 90, air can circulate in the skylight protection chamber 610, from a lower portion (from the outer face 512 of the lower frame member 500 in the embodiment shown) of the skylight protection assembly 100 towards the first and second lateral frame members 300, 300', so as to limit condensation on an inner face of the protection screen 600.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited by the scope of the appended claims.

The invention claimed is:

1. A skylight protection assembly to protect a skylight of a roof, the skylight protection assembly comprising:

a frame superposable to a mounting surface of the roof to surround at least partially the skylight and securable to the roof, the frame comprising a roof-engaging portion and a screen-supporting portion;

a protection screen engageable with the screen-supporting portion of the frame to define with the frame a skylight protection chamber configured to contain the skylight;

wherein the frame comprises an upper frame member, a lower frame member spaced-apart from the upper frame member and a pair of first and second lateral frame members spaced-apart from each other and extending between the upper and lower frame members, each of the upper, lower and first and second lateral frame members comprising a screen-supporting portion having a screen-contacting face, wherein at least one of the screen-contacting faces of the upper, lower and first and second lateral frame members is curved for the protection screen to have a substantially convex profile away from the skylight protection chamber when mounted to the frame.

2. The skylight protection assembly according to claim 1, wherein the upper frame member has a length and comprises opposed first and second longitudinal assembling ends engageable respectively with the first and second lateral frame members, the upper frame member further comprising an outer side, wherein the outer side has, considered in a plane substantially parallel to the mounting surface of the roof, a substantially convex profile along an entirety of the length of the upper frame member.

3. The skylight protection assembly according to claim 1, wherein the screen-contacting face of at least one of said upper, lower and first and second lateral frame members comprises an inner edge delimitating at least partially the skylight protection chamber and an outer edge, the screen-contacting face sloping downwardly from the inner edge towards the outer edge.

4. The skylight protection assembly according to claim 1, wherein at least one of the upper, lower and first and second lateral frame members comprises a roof-engaging portion and a sealing-receiving channel formed in a roof-juxtaposable face of the roof-engaging portion wherein said at least one of the upper, lower and first and second lateral frame members has a length with the sealing-receiving channel extending along substantially an entirety of the length.

5. The skylight protection assembly according to claim 1, wherein at least one of said upper, lower and first and second lateral frame members comprises a central core sandwiched between an inner layer and an outer layer.

6. The skylight protection assembly according to claim 5, wherein the outer layer is at least partially made of a water-resistant polymer and wherein the inner layer is at least partially made of laminated polyester.

7. The skylight protection assembly according to claim 5, wherein the central core has a density greater than a density of at least one of the inner and outer layers.

8. The skylight protection assembly according to claim 1, further comprising at least one screen connector configured to removably secure the protection screen to the frame, the at least one screen connector comprising a frame-mounting portion to be removably mounted to the screen-supporting portion of the frame, and a screen-receiving portion, a screen engagement slot being formed in the screen-receiving portion to receive an edge portion of the protection screen.

9. A skylight protection assembly to protect a skylight of a roof, the skylight protection assembly comprising:

a frame superposable to a mounting surface of the roof to surround at least partially the skylight and securable to the roof, the frame comprising a roof-engaging portion and a screen-supporting portion;

a protection screen engageable with the screen-supporting portion of the frame to define with the frame a skylight protection chamber configured to contain the skylight;

wherein said frame comprises at least a lower frame member comprising a roof-engaging portion, at least two spaced-apart air circulation indents being formed in a lower edge portion of the roof-engaging portion to allow an air circulation between the skylight protection chamber and an outside thereof, said at least two spaced-apart air circulation indents being separated from each other by a central roof-mounting base abuttable against the roof.

10. The skylight protection assembly according to claim 9, further comprising at least one screen connector configured to removably secure the protection screen to the frame, the at least one screen connector comprising a frame-mounting portion to be removablymountedw screen-supporting portion of the frame, and a screen-receiving portion, a screen engagement slot being formed in the screen-receiving portion to receive an edge portion of the protection screen.

11. The skylight protection assembly according to claim 9, wherein the frame further comprises an upper frame member spaced apart from the lower frame member and a pair of first and second lateral frame members spaced-apart from each other and extending between the upper and lower frame members, wherein the upper frame member has a length and comprises opposed first and second longitudinal assembling ends engageable respectively with the first and second lateral frame members, the upper frame member further comprising an outer side, wherein the outer side has, considered in a plane substantially parallel to the mounting surface of the roof, a substantially convex profile along an entirety of the length of the upper frame member.

12. The skylight protection assembly according to claim 11, wherein each of the upper, lower and first and second lateral frame members comprises a screen-supporting portion having a screen-contacting face, wherein at least one of the screen-contacting faces of the upper, lower and first and second lateral frame members is curved for the protection screen to have a substantially convex profile away from the skylight protection chamber when mounted to the frame.

13. The skylight protection assembly according to claim 12, wherein the screen-contacting face of at least one of said upper, lower and first and second lateral frame members comprises an inner edge delimitating at least partially the skylight protection chamber and an outer edge, the screen-contacting face sloping downwardly from the inner edge towards the outer edge.

14. The skylight protection assembly according to claim 11, wherein at least one of said upper, lower and first and second lateral frame members comprises a central core sandwiched between an inner layer and an outer layer, the central core having a density greater than a density of at least one of the inner and outer layers.

15. A skylight protection assembly to protect a skylight of a roof, the skylight protection assembly comprising:

a frame superposable to a mounting surface of the roof to surround at least partially the skylight and securable to the roof, the frame comprising a roof-engaging portion and a screen-supporting portion;

a protection screen engageable with the screen-supporting portion of the frame to define with the frame a skylight protection chamber configured to contain the skylight;

wherein said frame comprises an upper frame member, a lower frame member spaced-apart from the upper frame member and a pair of first and second lateral frame members spaced-apart from each other and extending between the upper and lower frame members;

wherein the upper frame member has a length and comprises a roof-engaging portion and opposed first and second longitudinal assembling ends engageable respectively with the first and second lateral frame members, the upper frame member further comprising an outer side, wherein the outer side has, considered in a plane substantially parallel to the mounting surface of the roof, a substantially convex profile along an entirety of the length of the upper frame member extending from the first longitudinal assembling end to the second longitudinal assembling end.

16. The skylight protection assembly according to claim 15, wherein each of the upper, lower and first and second lateral frame members comprises a screen-supporting portion having a screen-contacting face, wherein at least one of the screen-contacting faces of the upper, lower and first and second lateral frame members is curved for the protection screen to have a substantially convex profile away from the skylight protection chamber when mounted to the frame.

17. The skylight protection assembly according to claim 16, wherein the screen-contacting face of at least one of said upper, lower and first and second lateral frame members comprises an inner edge delimitating at least partially the skylight protection chamber and an outer edge, the screen-contacting face sloping downwardly from the inner edge towards the outer edge.

18. The skylight protection assembly according to claim 15, wherein at least one of said upper, lower and first and second lateral frame members comprises a central core sandwiched between an inner layer and an outer layer.

19. The skylight protection assembly according to claim 15, further comprising at least one screen connector configured to removably secure the protection screen to the frame, the at least one screen connector comprising a frame-mounting portion to be removably mounted to the screen-supporting portion of the frame, and a screen-receiving portion, a screen engagement slot being formed in the screen-receiving portion to receive an edge portion of the protection screen.

20. The skylight protection assembly according to claim 15, wherein the upper frame member comprises a deflector located in the roof-engaging portion and protruding outwardly from the outer side with respect to an upper portion of the upper frame member.

* * * * *